US007837547B2

(12) United States Patent
Cannon

(10) Patent No.: US 7,837,547 B2
(45) Date of Patent: Nov. 23, 2010

(54) GAMING DEVICE HAVING A WAGERING GAME WHEREIN A WAGER AMOUNT IS AUTOMATICALLY DETERMINED BASED ON A QUANTITY OF PLAYER SELECTIONS

(75) Inventor: Lee E. Cannon, Bozeman, MT (US)

(73) Assignee: IGT, Reno, NV (US)

( * ) Notice: Subject to any disclaimer, the term of this patent is extended or adjusted under 35 U.S.C. 154(b) by 1146 days.

(21) Appl. No.: 11/011,810

(22) Filed: Dec. 14, 2004

(65) Prior Publication Data

US 2006/0128457 A1 Jun. 15, 2006

(51) Int. Cl.
*A63F 9/00* (2006.01)

(52) U.S. Cl. ..... 463/16

(58) Field of Classification Search ..... 463/18
See application file for complete search history.

(56) References Cited

U.S. PATENT DOCUMENTS 3,533,629 A 10/1970 Raven et al.
4,033,588 A 7/1977 Watts
4,157,829 A 6/1979 Goldman et al.
4,335,809 A 6/1982 Wain
4,339,798 A 7/1982 Hedges et al.
4,467,424 A 8/1984 Hedges et al.
4,494,197 A 1/1985 Troy et al.
4,582,324 A 4/1986 Koza et al.
4,652,998 A 3/1987 Koza et al.
4,669,730 A 6/1987 Small
4,689,742 A 8/1987 Troy et al.
4,695,053 A 9/1987 Vazquez et al.
4,756,531 A 7/1988 DiRe et al.
4,775,155 A 10/1988 Lees
4,805,907 A 2/1989 Hagiwara
4,815,741 A 3/1989 Small
4,817,951 A 4/1989 Crouch et al.

(Continued)

FOREIGN PATENT DOCUMENTS

GB 2 374 294 A 10/2002

(Continued)

OTHER PUBLICATIONS

Big Top Keno Advertisement, written by Aristocrat, published Oct. 2000.

(Continued)

*Primary Examiner*—Peter DungBa Vo
*Assistant Examiner*—Seng Heng Lim
(74) *Attorney, Agent, or Firm*—K&L Gates LLP

(57) ABSTRACT

A number matching game which can be employed in both a gaming device and in live gaming at a casino is disclosed. The player picks one or more number spots from a number pool. The gaming device or house draws randomly at least one number from the same pool. An award is provided to the player based on an amount of matches between the player selected number(s) (the spots) and the game drawn number (s). In one embodiment, the amount of the player's wager is a function of the number of spots the player selects. For example, an additional credit may be automatically wagered for each spot selected over a predefined threshold. In addition, the award provided to the player may be less than the amount wagered.

41 Claims, 18 Drawing Sheets

U.S. PATENT DOCUMENTS 4,836,546 A 6/1989 DiRe
4,836,548 A 6/1989 Chittenden
4,842,278 A 6/1989 Markowicz
4,856,787 A 8/1989 Itkis
4,982,337 A 1/1991 Burr et al.
5,042,809 A 8/1991 Richardson
5,046,737 A 9/1991 Fienberg
5,092,598 A 3/1992 Kamille
5,100,139 A 3/1992 Di Bella
5,116,049 A 5/1992 Sludikoff et al.
5,158,293 A 10/1992 Mullins
5,242,163 A 9/1993 Fulton
5,257,784 A * 11/1993 Boylan et al. ..... 463/18
5,265,874 A 11/1993 Dickinson et al.
5,276,312 A 1/1994 McCarthy
5,282,620 A 2/1994 Keesee
5,324,035 A 6/1994 Morris et al.
5,398,932 A 3/1995 Eberhardt et al.
5,401,024 A 3/1995 Simunek
5,407,199 A 4/1995 Gumina
5,586,937 A 12/1996 Menashe
5,628,684 A 5/1997 Bouedec
5,639,089 A 6/1997 Matsumoto et al.
5,647,798 A 7/1997 Falciglia
5,651,735 A * 7/1997 Baba ..... 463/18
5,674,128 A 10/1997 Holch et al.
5,718,631 A 2/1998 Invencion
5,755,619 A 5/1998 Matsumoto et al.
5,779,545 A 7/1998 Berg et al.
5,800,269 A 9/1998 Holch et al.
5,813,911 A * 9/1998 Margolin ..... 463/19
5,871,398 A 2/1999 Schneier et al.
5,909,875 A 6/1999 Weingardt
5,935,002 A 8/1999 Falciglia
5,944,606 A 8/1999 Gerow
5,949,042 A 9/1999 Dietz, II et al.
5,954,582 A 9/1999 Zach
5,970,143 A 10/1999 Schneier et al.
5,971,849 A 10/1999 Falciglia
6,017,032 A 1/2000 Grippo et al.
6,024,640 A 2/2000 Walker et al.
6,033,306 A 3/2000 DeSouza
6,079,711 A 6/2000 Wei et al.
6,089,982 A 7/2000 Holch et al.
6,099,408 A 8/2000 Schneir et al.
6,102,400 A 8/2000 Scott et al.
6,117,009 A 9/2000 Yoseloff
6,129,632 A 10/2000 Luciano
6,146,272 A 11/2000 Walker et al.
6,168,521 B1 1/2001 Luciano et al.
6,183,361 B1 * 2/2001 Cummings et al. ..... 463/18
6,203,428 B1 3/2001 Giobbi et al.
6,210,275 B1 4/2001 Olsen
6,210,276 B1 4/2001 Mullins
6,210,279 B1 4/2001 Dickinson
6,217,448 B1 4/2001 Olsen
6,220,961 B1 4/2001 Keane et al.
6,241,606 B1 6/2001 Riendeau et al.
6,250,685 B1 6/2001 Walker et al.
6,254,480 B1 7/2001 Zach
6,273,820 B1 8/2001 Haste, III
6,280,328 B1 8/2001 Holch et al.
6,283,855 B1 9/2001 Bingham
6,309,298 B1 10/2001 Gerow
6,315,291 B1 11/2001 Moody
6,325,716 B1 12/2001 Walker et al.
6,331,143 B1 * 12/2001 Yoseloff ..... 463/18
6,336,862 B1 1/2002 Byrne
6,358,151 B1 3/2002 Enzminger et al.
6,364,313 B1 4/2002 Moody
6,368,213 B1 * 4/2002 McNabola ..... 463/18
6,368,214 B1 4/2002 Luciano
6,368,218 B2 4/2002 Angell, Jr.
6,398,644 B1 6/2002 Perrie et al.
6,398,645 B1 6/2002 Yoseloff
6,402,614 B1 6/2002 Schneier et al.
6,419,583 B1 7/2002 Crumby et al.
6,425,823 B1 7/2002 Byrne
6,443,837 B1 9/2002 Jaffe et al.
6,450,885 B2 9/2002 Schneier et al.
6,454,648 B1 9/2002 Kelly et al.
RE37,885 E 10/2002 Acres et al.
6,464,582 B1 10/2002 Baerlocher et al.
6,475,086 B2 11/2002 Zach
6,478,677 B1 11/2002 Moody
6,508,711 B1 1/2003 Ono
6,514,144 B2 2/2003 Riendeau et al.
6,524,184 B1 2/2003 Lind et al.
6,527,638 B1 3/2003 Walker et al.
6,533,660 B2 3/2003 Seelig et al.
6,533,664 B1 3/2003 Crumby
6,537,150 B1 3/2003 Luciano et al.
6,656,044 B1 12/2003 Lewis
6,682,420 B2 * 1/2004 Webb et al. ..... 463/16
6,702,699 B2 3/2004 Touhey et al.
6,729,961 B1 5/2004 Millerschone
6,739,970 B2 5/2004 Luciano
6,749,500 B1 6/2004 Nelson et al.
6,764,397 B1 7/2004 Robb
6,824,465 B2 11/2004 Luciano, Jr.
6,855,055 B2 2/2005 Perrie et al.
7,399,227 B2 * 7/2008 Michaelson et al. ..... 463/18
2002/0010013 A1 1/2002 Walker et al.
2002/0037766 A1 * 3/2002 Muniz ..... 463/17
2002/0058545 A1 * 5/2002 Luciano ..... 463/18
2002/0072404 A1 6/2002 Gerow
2002/0082070 A1 6/2002 Macke et al.
2002/0098882 A1 7/2002 Lind et al.
2002/0098883 A1 7/2002 Packes, Jr. et al.
2002/0111214 A1 8/2002 Lind et al.
2002/0113369 A1 8/2002 Weingardt
2002/0169018 A1 11/2002 Schneier et al.
2002/0198044 A1 * 12/2002 Walker et al. ..... 463/25
2003/0148812 A1 * 8/2003 Paulsen et al. ..... 463/42
2003/0181234 A1 9/2003 Falciglia, Sr.
2003/0193136 A1 10/2003 Walker et al.
2004/0023715 A1 * 2/2004 Luciano, Jr. ..... 463/25
2004/0106445 A1 6/2004 Perrie et al.
2005/0014553 A1 1/2005 Byrne
2005/0037832 A1 * 2/2005 Cannon ..... 463/18
2005/0059466 A1 * 3/2005 Yarbrough ..... 463/18
2005/0227753 A1 * 10/2005 Luciano ..... 463/18
2006/0025190 A1 * 2/2006 Kraft et al. ..... 463/13
2006/0094494 A1 * 5/2006 O'Halloran et al. ..... 463/18
2006/0178196 A1 * 8/2006 Thomas ..... 463/18
2006/0189375 A1 * 8/2006 Dodge ..... 463/18

FOREIGN PATENT DOCUMENTS

WO WO 02/097749 A2 12/2002
WO WO 2004/014502 A2 2/2004

OTHER PUBLICATIONS

Bingo Advertisement, written by Casino Data Systems, published 1998.
Bingo Advertisement, written by WMS Gaming, Inc., published prior to 2003.
Bing Ball Bingo Advertisement, written by BCSI Corporation, published prior to 2003.
Bingo Brasil Advertisement, written by Unidesa Gaming, published prior to 2003.
Bingo Game Station Advertisement, written by Cole Gaming Technologies, published prior to 2003.

Bingo Party Advertisement, written by Amatic Industries, published 2001.
Bingo Slot Advertisement, written by Unidesa Gaming, published prior to 2003.
Bingo Slots Advertisement, written by Odds on Gaming, published prior to 2003.
Bingo Wizard Advertisement, written by Applied Concepts, published 2002.
Bonus Bingo Advertisement, written by Unidesa Gaming, published prior to 2003.
California Dreams Advertisement, written by Cadillac Jack, published prior to 2003.
Canadian Bingo Advertisement, written by Unidesa Gaming, published prior to 2003.
Diamonopoly Advertisement, written by International Gamco, Inc., published 2002.
Dual Screen Keno Machine Picture Advertisement, written by Acres Gaming, Inc., published prior to 2003.
Electronic Pull Tabs Advertisement, written by 21st Century Gaming, published prior to 2002.
Five Card Instant Bingo Advertisement, written by IGT, published 2000.
Flamingo Reno-Keno, published prior to 2003.
Free Game Keno, written by Keno-Info.com (website: www.keno-info.com/free_keno_game.html), website published 2002, printed on Aug. 11, 2002.
Four Card Keno Game Screen Advertisement, written by IGT, published prior to 2001.
Gold Touch Multi-Game Advertisement, written by Cadillac Jack, published prior to 2003.
Instant Bingo Video Slots Advertisement, written by IGT, published 2002.
Instant Winner Advertisement, written by Williams/WMS Gaming, published prior to 2002.
Keno Advertisement, written by Cyberdyne Gaming, published prior to 2003.
Keno Advertisement, written by Odds on Gaming, published prior to 2003.
Keno Advertisement, written by WMS Gaming, Inc., published prior to 2003.
Krazy Keno Advertisement, written by Silicon Gaming, published prior to 2001.
Lucky Times California Lottery Newsletter, published 1996.
Party Time Bingo Advertisement, written by Astra Games Limited, published prior to 2003.
Play it Again Advertisement, written by International Gamco, Inc., published 2000.
Pot O' Gold Advertisement, written by Vision Gaming & Technology, published prior to 2003.
Reel Bingo Advertisement, written by B Soft, published prior to 2003.
Southern Gold Advertisement, written by Cadillac Jack, published prior to 2003.
Star Spangled Keno, Advertisement, written by Silicon Gaming, published 2001.
Ultimate Keno Advertisement, written by Bally Gaming Systems, published 2000.
Alley Cat Keno Game Description, written by IGT, available prior to Dec. 14, 2004.
Cleopatra Bingo Advertisement, written by IGT, published in 2000 and 2004.
Slingo Games, written by Slingo.com Slingo Games (website: www.slingo.com/games/online/game.php), printed on Apr. 25, 2003.

* cited by examiner

Selected Spots: 3
Automatic Wager: 1 Credit

FIG. 18

| Points Earned | Probability | Odds | Credits Paid | Percent |
|---|---|---|---|---|
| 30 | 0.0243% | 4108.00 | 100 | 2.43% |
| 22 to 29 | 0.3286% | 304.30 | 19 | 6.24% |
| 18 to 21 | 1.8111% | 55.22 | 7 | 12.68% |
| 14 to 17 | 4.8369% | 20.67 | 4 | 19.35% |
| 11 to 13 | 9.7955% | 10.21 | 2 | 19.59% |
| 5 to 10 | 32.1811% | 3.11 | 1 | 32.18% |
| 0 to 4 | 51.0224% | 1.96 | | |
| Totals | 100.0000% | 1.00 | Payback | 92.48% |
| Win | 48.9776% | 2.04 | Win frequency | 48.98% |
| Any Hit | 87.9747% | 1.14 | Hit frequency | 87.97% |

Selected Spots: 4
Automatic Wager: 2 Credits

FIG. 19

| Points Earned | Probability | Odds | Credits Paid | Percent |
|---|---|---|---|---|
| 35 to 40 | 0.0111% | 9037.60 | 300 | 1.66% |
| 30 to 34 | 0.1100% | 908.95 | 100 | 5.50% |
| 22 to 29 | 1.3158% | 76.00 | 36 | 23.69% |
| 17 to 21 | 4.5004% | 22.22 | 10 | 22.50% |
| 12 to 16 | 14.7881% | 6.76 | 3 | 22.18% |
| 6 to 11 | 33.8813% | 2.95 | 1 | 16.94% |
| 0 to 5 | 45.3932% | 2.20 | | |
| Totals | 100.0000% | 1.00 | Payback | 92.47% |
| Win | 54.6068% | 1.83 | Win frequency | 54.61% |
| Any Hit | 94.2216% | 1.06 | Hit frequency | 94.22% |

Selected Spots: 5
Automatic Wager: 3 Credits

FIG. 20

| Points Earned | Probability | Odds | Credits Paid | Percent |
|---|---|---|---|---|
| 40 to 50 | 0.0070% | 14343.68 | 750 | 1.74% |
| 32 to 39 | 0.1252% | 798.67 | 200 | 8.35% |
| 25 to 31 | 1.6520% | 60.53 | 12 | 23.13% |
| 19 to 24 | 6.3817% | 15.67 | 10 | 21.27% |
| 15 to 18 | 11.1167% | 9.00 | 5 | 18.53% |
| 9 to 14 | 29.0159% | 3.45 | 2 | 19.34% |
| 0 to 8 | 51.7016% | 1.93 | | |
| Totals | 100.0000% | 1.00 | Payback | 92.36% |
| Win | 48.2984% | 2.07 | Win frequency | 48.30% |
| Any Hit | 97.2629% | 1.03 | Hit frequency | 97.26% |

Selected Spots: 6
Automatic Wager: 4 Credits

FIG. 21

| Points Earned | Probability | Odds | Credits Paid | Percent |
|---|---|---|---|---|
| 45 to 60 | 0.0035% | 28402.67 | 1250 | 1.10% |
| 36 to 44 | 0.1269% | 787.78 | 250 | 7.93% |
| 27 to 35 | 1.9139% | 52.25 | 50 | 23.92% |
| 22 to 26 | 5.1731% | 19.33 | 17 | 21.99% |
| 16 to 21 | 16.7524% | 5.97 | 6 | 25.13% |
| 11 to 15 | 24.6528% | 4.06 | 2 | 12.33% |
| 0 to 10 | 51.3773% | 1.95 | | |
| Totals | 100.0000% | 1.00 | Payback | 92.40% |
| Win | 48.6227% | 2.06 | Win Freq | 48.62% |
| Any Hit | 98.7227% | 1.01 | Hit Freq | 98.72% |

FIG. 22

Max Pts 65

Marks 7
Wager 5

| Min Pts | Probability | Odds | Pay | Percent |
|---|---|---|---|---|
| 48 | 4.15E-05 | 24095.24 | 1500 | 1.25 |
| 41 | 6.42E-04 | 1556.56 | 400 | 5.14 |
| 33 | 8.34E-03 | 119.87 | 150 | 25.03 |
| 27 | 3.29E-02 | 30.36 | 35 | 23.05 |
| 20 | 1.34E-01 | 7.48 | 9 | 24.07 |
| 12 | 3.50E-01 | 2.86 | 2 | 13.99 |
| 0 | 4.74E-01 | 2.11 | | |
| Totals | 1.00E+00 | 1.00 | Payback | 92.53 |
| Win | 5.26E-01 | 1.90 | Win Freq | 52.55 |
| Any Hit | 9.94E-01 | 1.01 | Hit Freq | 99.41 |

FIG. 23

Max Pts 70

Marks 8
Wager 6

| Min Pts | Probability | Odds | Pay | Percent |
|---|---|---|---|---|
| 51 | 4.73E-05 | 21158.40 | 2000 | 1.58 |
| 45 | 4.32E-04 | 2316.60 | 800 | 5.76 |
| 34 | 1.43E-02 | 69.70 | 100 | 23.91 |
| 27 | 5.86E-02 | 17.07 | 25 | 24.41 |
| 20 | 1.75E-01 | 5.71 | 8 | 23.37 |
| 14 | 2.72E-01 | 3.68 | 3 | 13.60 |
| 0 | 4.79E-01 | 2.09 | | |
| Totals | 1.00E+00 | 1.00 | Payback | 92.63 |
| Win | 5.21E-01 | 1.92 | Win Freq | 52.07 |
| Any Hit | 9.97E-01 | 1.00 | Hit Freq | 99.73 |

Selected Spots: 9
Automatic Wager: 7 Credits

FIG. 24

| Points Earned | Probability | Odds | Credits Paid | Percent |
|---|---|---|---|---|
| 57 to 75 | 0.0012% | 80335.16 | 3200 | 0.57% |
| 47 to 56 | 0.0659% | 1516.38 | 800 | 7.54% |
| 37 to 46 | 1.2637% | 79.13 | 140 | 25.27% |
| 31 to 36 | 4.0108% | 24.93 | 40 | 22.92% |
| 23 to 30 | 16.4685% | 6.07 | 10 | 23.53% |
| 16 to 22 | 29.3716% | 3.40 | 3 | 12.59% |
| 0 to 15 | 48.8181% | 2.05 | | |
| Totals | 100.0000% | 1.00 | Payback | 92.41% |
| Win | 51.1819% | 1.95 | Win frequency | 51.18% |
| Any Hit | 99.8821% | 1.00 | Hit frequency | 99.88% |

Selected Spots: 10
Automatic Wager: 8 Credits

FIG. 25

| Points Earned | Probability | Odds | Credits Paid | Percent |
|---|---|---|---|---|
| 60 to 80 | 0.0014% | 71635.58 | 3200 | 0.56% |
| 50 to 59 | 0.0638% | 1567.37 | 1000 | 7.98% |
| 40 to 49 | 1.1392% | 87.78 | 200 | 28.48% |
| 33 to 39 | 4.5356% | 22.05 | 40 | 22.68% |
| 27 to 32 | 10.9049% | 9.17 | 15 | 20.45% |
| 18 to 26 | 33.5928% | 2.98 | 3 | 12.60% |
| 0 to 17 | 49.7624% | 2.01 | | |
| Totals | 100.0000% | 1.00 | Payback | 92.74% |
| Win | 50.2376% | 1.99 | Win frequency | 50.24% |
| Any Hit | 99.9485% | 1.01 | Hit frequency | 99.95% |

FIG. 26

| Bet | Spots | Hits | Probability | Odds | Credits Paid | Percent |
|---|---|---|---|---|---|---|
| 1 | 3 | 0 | 41.6500% | 2.4 | | 0.00% |
| | | 1 | 43.0870% | 2.3 | 1 | 43.09% |
| | | 2 | 13.8750% | 7.2 | 2 | 27.75% |
| | | 3 | 1.3875% | 72.1 | 15 | 20.81% |
| | Total Plays | | 100% | 1.0 | Payback | 91.65% |
| | Total Wins | | 58.3500% | 1.7 | Win Frequency | 58.35% |

FIG. 27

| Bet | Spots | Hits | Probability | Odds | Credits Paid | Percent |
|---|---|---|---|---|---|---|
| 2 | 4 | 0 | 30.8320% | 3.2 | | 0.00% |
| | | 1 | 43.2730% | 2.3 | | 0.00% |
| | | 2 | 21.2640% | 4.7 | 4 | 42.53% |
| | | 3 | 4.3248% | 23.1 | 17 | 36.76% |
| | | 4 | 0.3063% | 326.4 | 80 | 12.25% |
| | Total Plays | | 100% | 1.0 | Payback | 91.54% |
| | Total Wins | | 25.8950% | 3.9 | Win Frequency | 25.89% |

FIG. 28

| Bet | Spots | Hits | Probability | Odds | Credits Paid | Percent |
|---|---|---|---|---|---|---|
| 3 | 5 | 0 | 22.7180% | 4.4 | | 0.00% |
| | | 1 | 40.5690% | 2.5 | | 0.00% |
| | | 2 | 27.0460% | 3.7 | 3 | 27.05% |
| | | 3 | 8.3935% | 11.9 | 11 | 30.78% |
| | | 4 | 1.2092% | 82.7 | 73 | 29.42% |
| | | 5 | 0.0645% | 1550.6 | 200 | 4.30% |
| | Total Plays | | 100% | 1.0 | Payback | 91.55% |
| | Total Wins | | 36.7130% | 2.7 | Win Frequency | 36.71% |

FIG. 29

| Bet | Spots | Hits | Probability | Odds | Credits Paid | Percent |
|---|---|---|---|---|---|---|
| 4 | 6 | 0 | 16.6600% | 6.0 | | 0.00% |
| | | 1 | 36.3490% | 2.8 | | 0.00% |
| | | 2 | 30.8320% | 3.2 | 3 | 23.12% |
| | | 3 | 12.9820% | 7.7 | 10 | 32.45% |
| | | 4 | 2.8538% | 35.0 | 37 | 26.40% |
| | | 5 | 0.3100% | 323.0 | 100 | 7.74% |
| | | 6 | 0.0129% | 7752.8 | 500 | 1.61% |
| | Total Plays | | 100% | 1.0 | Payback | 91.33% |
| | Total Wins | | 46.9900% | 2.1 | Win Frequency | 46.99% |

FIG. 30

| Bet | Spots | Hits | Probability | Odds | Credits Paid | Percent |
|---|---|---|---|---|---|---|
| 5 | 7 | 0 | 12.1570% | 8.2 | | 0.00 |
| | | 1 | 31.5190% | 3.2 | | 0.00 |
| | | 2 | 32.6650% | 3.1 | 3 | 19.60 |
| | | 3 | 17.4990% | 5.7 | 7 | 24.50 |
| | | 4 | 5.2191% | 19.2 | 23 | 24.01 |
| | | 5 | 0.8640% | 115.8 | 100 | 17.28 |
| | | 6 | 0.0732% | 1366.0 | 400 | 5.86 |
| | | 7 | 0.0024% | 40979.3 | 1000 | 0.49 |
| | Total Plays | | 100% | 1.0 | Payback | 91.73 |
| | Total Wins | | 56.3230% | 1.8 | Win Frequency | 56.32 |

FIG. 31

| Bet | Spots | Hits | Probability | Odds | Credits Paid | Percent |
|---|---|---|---|---|---|---|
| 6 | 8 | 0 | 8.8270% | 11.3 | | 0.00 |
| | | 1 | 26.6460% | 3.8 | | 0.00 |
| | | 2 | 32.8150% | 3.0 | | 0.00 |
| | | 3 | 21.4790% | 4.7 | 6 | 21.48 |
| | | 4 | 8.1504% | 12.3 | 21 | 28.53 |
| | | 5 | 1.8303% | 54.6 | 88 | 26.84 |
| | | 6 | 0.2370% | 422.5 | 300 | 11.83 |
| | | 7 | 0.0160% | 6323.3 | 1000 | 2.67 |
| | | 8 | 0.0004% | 230114.6 | 2500 | 0.18 |
| | Total Plays | | 100% | 1.0 | Payback | 91.54 |
| | Total Wins | | 31.7120% | 3.2 | Win Frequency | 31.71 |

FIG. 32

| Bet | Spots | Hits | Probability | Odds | Credits Paid | Percent |
|---|---|---|---|---|---|---|
| 7 | 9 | 0 | 6.3750% | 15.7 | | 0.00 |
| | | 1 | 22.0670% | 4.5 | | 0.00 |
| | | 2 | 31.6430% | 3.2 | | 0.00 |
| | | 3 | 24.6110% | 4.1 | 6 | 21.10 |
| | | 4 | 11.4110% | 8.8 | 14 | 22.82 |
| | | 5 | 3.2601% | 30.7 | 50 | 23.29 |
| | | 6 | 0.5720% | 174.8 | 200 | 16.34 |
| | | 7 | 0.0592% | 1960.1 | 850 | 7.18 |
| | | 8 | 0.0033% | 30681.9 | 2000 | 0.93 |
| | | 9 | 0.0001% | 1380687.6 | 5000 | 0.05 |
| | Total Plays | | 100% | 1.0 | Payback | 91.71 |
| | Total Wins | | 39.9160% | 2.5 | Win Frequency | 39.92 |

FIG. 33

| Bet | Spots | Hits | Probability | Odds | Credits Paid | Percent |
|---|---|---|---|---|---|---|
| 8 | 10 | 0 | 4.5791% | 21.8 | | 0.00 |
| | | 1 | 17.9570% | 5.6 | | 0.00 |
| | | 2 | 29.5260% | 3.4 | | 0.00 |
| | | 3 | 26.7400% | 3.7 | 6 | 20.06 |
| | | 4 | 14.7320% | 6.8 | 12 | 22.10 |
| | | 5 | 5.1428% | 19.4 | 30 | 19.29 |
| | | 6 | 1.1480% | 87.1 | 115 | 16.50 |
| | | 7 | 0.1611% | 620.7 | 500 | 10.07 |
| | | 8 | 0.0140% | 7384.5 | 2000 | 3.39 |
| | | 9 | 0.0010% | 163381.4 | 5000 | 0.38 |
| | | 10 | 0.0000% | 8911711.2 | 10000 | 0.01 |
| | Total Plays | | 100% | 1.0 | Payback | 91.79 |
| | Total Wins | | 47.9380% | 2.1 | Win Frequency | 47.94 |

GAMING DEVICE HAVING A WAGERING GAME WHEREIN A WAGER AMOUNT IS AUTOMATICALLY DETERMINED BASED ON A QUANTITY OF PLAYER SELECTIONS

CROSS REFERENCE TO RELATED APPLICATIONS

This application relates to the following co-pending, commonly owned applications: "GAMING DEVICE HAVING FREE GAME KENO," Ser. No. 10/243,051; "GAMING DEVICE HAVING GAME WITH SEQUENTIAL DISPLAY OF NUMBERS," Ser. No. 10/639,715; "CENTRAL DETERMINATION SYSTEM WITH A KENO GAME," Ser. No. 10/601,482; and "GAMING DEVICE HAVING MATCHING GAME WITH IMPROVED DISPLAY," Ser. No. 10/953,430.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

The disclosed system relates to gaming devices. More particularly, the disclosed system relates to lottery based games such as Keno, Lotto, and Bingo.

Although the disclosed system is applicable to any suitable lottery based casino game, for ease of illustration, the system is described mainly in connection with Keno and in particular gaming devices such as Video Keno games. Keno in the U.S. traces back to a game brought to the United States by Chinese immigrants in the 1800's. The Chinese game used a board and a set of up to one hundred and twenty characters instead of numbers. Early versions of American Keno used characters on the Keno ticket, rather than the numbers used today. The American game dropped the number of characters to the more familiar eighty.

When gambling was legalized in the state of Nevada in 1931, the "Chinese lottery" game was referred to instead as Horse Race Keno, referring to the idea that the numbers are horses and the player wants the wagered horse to come in. Later, the name was shortened to simply Keno, although the game is still referred to often as Horse Race Keno.

Keno is similar to a lottery game. The goal, like a lottery, is to choose a winning number or numbers from a plurality of numbers. In most versions of Keno, the gaming machine displays or the player receives a card with eighty squares numbered one to eighty, arranged in rows of ten. The player can bet on any suitable number or numbers, up to some predetermined limit, which the player does by marking selected numbers on a Keno card. In the video version, the player selects the numbers such as by touching a touch screen. In a paper version, a clerk records the player's bet(s).

In the paper version, the Keno numbers also appear on eighty ping pong type balls, which can be tossed about in a clear plastic sphere, spun around in a wire bird cage or mixed in other suitable apparatus. Keno numbers were at one time drawn using a manually powered Keno goose. Later, a number of different lottery styles were used. Today, in the paper version and in the video version, Keno numbers are generally generated via computers using random number generators. When a number is chosen, the number is shown electronically on Keno boards throughout the casino or on the video monitor.

For the paper version, a number of Keno outlets and Keno monitors are typically placed in various places around a casino or gaming establishment. In certain types of Keno, the player must return a winning ticket to the Keno ticket writer before the next game starts (usually about five minutes) or forfeit the win. Other types of Keno allow the player additional time.

Many casinos offer "multi-race" cards, which allow the player to play the same set of numbers over multiple games. One type of "multi" game enables the player to wager a single set of numbers over as many as twenty games. When finished, the player must return to the Keno station and cash in any wins. "Stray and play" tickets are also available, which allow the player to play a version of Keno called "walk away Keno." Here, players can purchase a Keno ticket for an extended number of games, enjoy other activities in the casino and return at a later time or even a later date to have the tickets checked by a computer for winning games.

Another option for Keno players is a combination or "way" ticket. A combination ticket enables the player to group different numbers, wherein each group has the same amount of numbers, creating more than one way to win. For example, a 3×3×3, nine spot ticket enables the player to select a combination of three groups of three numbers. The player can, for example, mark a first group of three numbers with the letter "A," mark a second group with the letter "B" and mark a third group the letter "C." This ticket enables the player to win on any winning combination of three numbers for any of the three groups. Hitting any winning combination pays as though a single ticket had been played. Essentially, the player plays three games on one card.

The "way" ticket supposedly makes Keno more exciting, enabling players to wager more money on more numbers. In reality, playing a way or combination ticket offers no mathematical advantage, and no disadvantage, to the player. Some casinos offer discounted minimum bets with "way" tickets. If the player plays three or more ways, many casinos will discount the price per "way" (e.g., let the player bet $0.50 per wager instead of a usual $1 minimum). The casino however only pays back on the player's actual bet.

Certain variations of Keno have expected returns that are relatively constant regardless of how many numbers (i.e., spots) the player plays. That is, it does not mathematically matter how many numbers the player chooses or if the player combines wagers. In other versions, the expected value fluctuates based on how many numbers the player plays.

In existing Keno games, the player selects a wager amount independent of the number spots selected by the player. For example, the player may choose to wager two credits on a seven spot game and then one credit on a five spot game. If the player wins, the award is an integer multiple of the wager. For example, a wager of five credits may result in an award of five, ten, fifteen, twenty, etc. credits. However, a wager of five credits typically would not result in an award of e.g., three credits or twelve credits.

However, a need exists to provide a new Keno game wherein the player's wager amount is automatically determined based on the number of spots selected by the player. In addition, there is a need to provide a new Keno game with a higher "win" frequency (i.e., more game plays with some amount of payback to the player) to make the play of both the video and casino versions of Keno more enjoyable, fun and exciting.

SUMMARY

The present disclosure provides improved number matching games, such as Keno, Lotto and Bingo, which can be employed in both a gaming device and also in live gaming at a casino. The gaming system disclosed herein uses a cost per pick based wagering scheme. In one embodiment, the gaming device includes a wagering game wherein the wager amount is automatically determined based on a quantity of player selections. In one such embodiment, the system or gaming device enables a player to select a plurality of selections in the form of numbers or other symbols displayed in a game, and the amount of the player's wager is automatically determined by the gaming machine based on how many numbers the player selects.

In one embodiment, there is a one-to-one correspondence between the number of player selections and the number of credits wagered. For example, if the player selects one Keno spot or number, then one credit is wagered. If the player selects two Keno spots or numbers, then two credits are wagered, etc. In this example, the player may play the game if the player has any number of credits in the gaming device (i.e., there is no minimum wager).

In another embodiment, there is a one-to-many correspondence between the number of player selections and the number of credits wagered. For example, if the player selects one Keno spot or numbers, then two credits are wagered. If the player selects two Keno spots or number, then four credits are wagered, etc. In another example, if the player selects two Keno spots or numbers, then one credit is wagered. If the player selects four Keno spots or numbers, then two credits are wagered, etc.

In another embodiment, there is a one-to-many correspondence for some player selections and a one-to-one correspondence for other player selections during the same game. For example, the game may enable the player to pick three Keno spots or numbers for a first credit wagered (i.e., on a one to many basis) and then up to seven additional Keno spots or numbers for one more credit each (i.e., on a one to one basis). In another example, the game may enable the player to pick each of three Keno spots or numbers each for a credit wagered (i.e., on a one to one basis) and then up to seven additional Keno spots or numbers for one more credit (i.e., on a one to many basis). The present invention contemplates various alternatives and combinations of this including but not limited to different credit amounts associated with different numbers of picks.

After the player has chosen the maximum number of selections (e.g., 10) or selected a play button or input after choosing less than the maximum number of selections, the gaming machine reveals a winning set of numbers and displays how many matches occurred between the winning set of numbers and the player selected numbers. If a predetermined minimum number of matches occurs, the game awards the player a predetermined number of credits.

The number of credits awarded by the game may be less than the amount the player wagered. For example, the player may select five Keno spots resulting in an automatic wager of five credits in the one-to-one wagering embodiment. However, the player in this example may be awarded with three credits. In this manner, a new number matching game with a higher win frequency (i.e., more game plays with some amount of payback to the player) is achieved. This increases player satisfaction due to an increased feeling of winning.

Other objects, features and advantages of the present invention will be apparent from the following detailed disclosure, taken in conjunction with the accompanying sheets of drawings, wherein like numerals refer to like parts, elements, components, steps and processes.

BRIEF DESCRIPTION OF THE FIGURES

FIG. 18 is an example pay table associated with a three spot Keno game wherein one credit is wagered.

FIG. 19 is an example pay table associated with a four spot Keno game wherein two credits are wagered.

FIG. 20 is an example pay table associated with a five spot Keno game wherein three credits are wagered.

FIG. 21 is an example pay table associated with a six spot Keno game wherein four credits are wagered.

FIG. 22 is an example pay table associated with a seven spot Keno game wherein five credits are wagered.

FIG. 23 is an example pay table associated with a eight spot Keno game wherein six credits are wagered.

FIG. 24 is an example pay table associated with a nine spot Keno game wherein seven credits are wagered.

FIG. 25 is an example pay table associated with a ten spot Keno game wherein eight credits are wagered.

FIG. 26 is an example pay table associated with another three spot Keno game wherein one credit is wagered.

FIG. 27 is an example pay table associated with another four spot Keno game wherein two credits are wagered.

FIG. 28 is an example pay table associated with another five spot Keno game wherein three credits are wagered.

FIG. 29 is an example pay table associated with another six spot Keno game wherein four credits are wagered.

FIG. 30 is an example pay table associated with another seven spot Keno game wherein five credits are wagered.

FIG. 31 is an example pay table associated with another eight spot Keno game wherein six credits are wagered.

FIG. 32 is an example pay table associated with another nine spot Keno game wherein seven credits are wagered.

FIG. 33 is an example pay table associated with another ten spot Keno game wherein eight credits are wagered.

DETAILED DESCRIPTION

Figure 1:
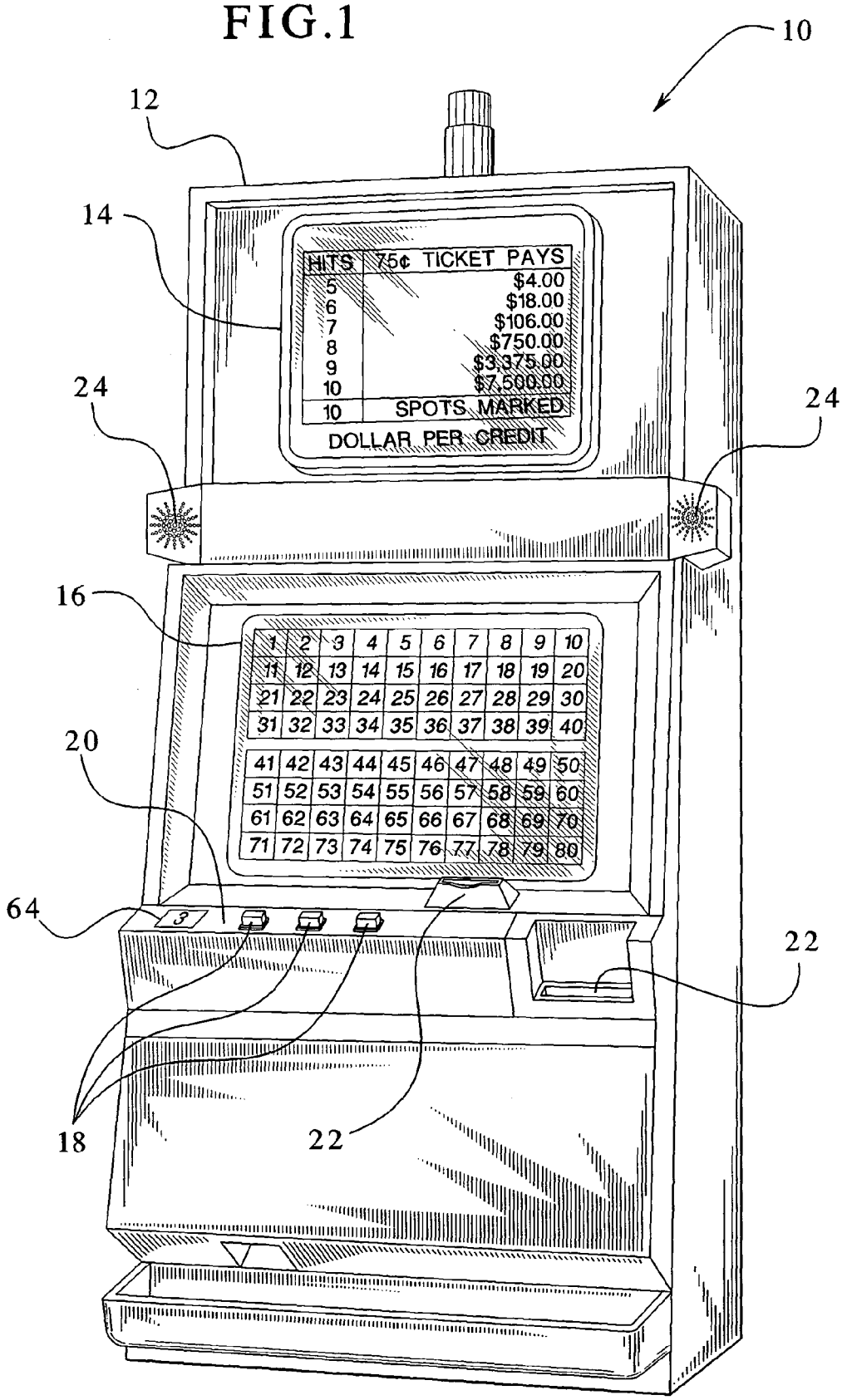
FIG. 1 is a perspective view of a gaming device incorporating a lottery type video game.

Referring now to FIG. 1, each of the embodiments described herein is provided in one preferred embodiment in a gaming device 10. Alternatively, certain embodiments are provided on various monitors throughout a casino or gaming establishment. Gaming device 10 is in one embodiment a video gaming device and includes a cabinet 12 having at least one video monitor. The illustrated embodiment includes two video monitors 14 and 16. Cabinet 12 is illustrated as being of a type where the player stands or sits. The cabinet is alternatively a bar top cabinet, wherein the player sits to play the Keno, Lotto or Bingo game. While the present system is applicable to any wagering game that displays numbers sequentially to show whether or how much the player wins, such as Keno, Bingo and Lotto, the description of the gaming device 10, for simplicity, is mainly directed to Keno.

The cabinet 12 also provides controls for a player to operate the gaming device 10. In the illustrated embodiment, various electromechanical input devices 18 are provided on a tilted portion 20 of the cabinet 12, below video monitors 14 and 16. Electromechanical input devices 18 each send a discrete signal to a microprocessor (described further below) located within cabinet 12. Those input devices enable the player to perform the various Keno functions, including but not limited to, selecting at least one of the Keno numbers, playing "ways" or multiple games at once, wagering a number of credits per game or "way" and cashing out. The input devices 18 also enable the player to play multiple Keno games in a row, analogous to the "multi-run" or "stray and play" Keno tickets offered by the casino.

Similar to the electromechanical input devices 18, cabinet 12 of gaming device 10 can provide electromechanical displays that show, for example, the player's credits maintained within gaming device 10, the number of Keno numbers played, the bet per game, etc. In one preferred embodiment, however, these functions as well as others are provided on one or more video monitors or display devices 14 and 16. In the illustrated embodiment, display device 14 shows the pays for a number of hits or matches between the numbers that the player selects and the numbers that gaming device 10 generates. Displays 14 and 16 can also inform the player of the rules concerning the operation of one or more of the games.

Video monitor 16 displays, without limitation: (i) the Keno numbers (or other symbols) generated by gaming device 10; (ii) the numbers selected by the player; (iii) the number of "ways" or simultaneous games played by the player, and the numbers selected by the player for each "way", (iv) the wager per game; (v) the player's total wager; and (vi) the player's Keno award, if any. In one embodiment, when the player selects or picks a number or the game generates a number, gaming device 10 highlights it as a certain color, for example, yellow.

Cabinet 12 of gaming device 10 also includes one or more monetary input devices 22. The monetary input device 22 can accept coins, cash, a smart card, a credit card, a debit card, a casino card or other type of gaming device card. Keno gaming device 10 can also include a ticket reader and a ticket printer (not illustrated) that enables the player to input and receive a redeemable ticket in lieu of cash. The ticket reader/validator and printer operate with the processor housed inside gaming device 10.

Figure 2:
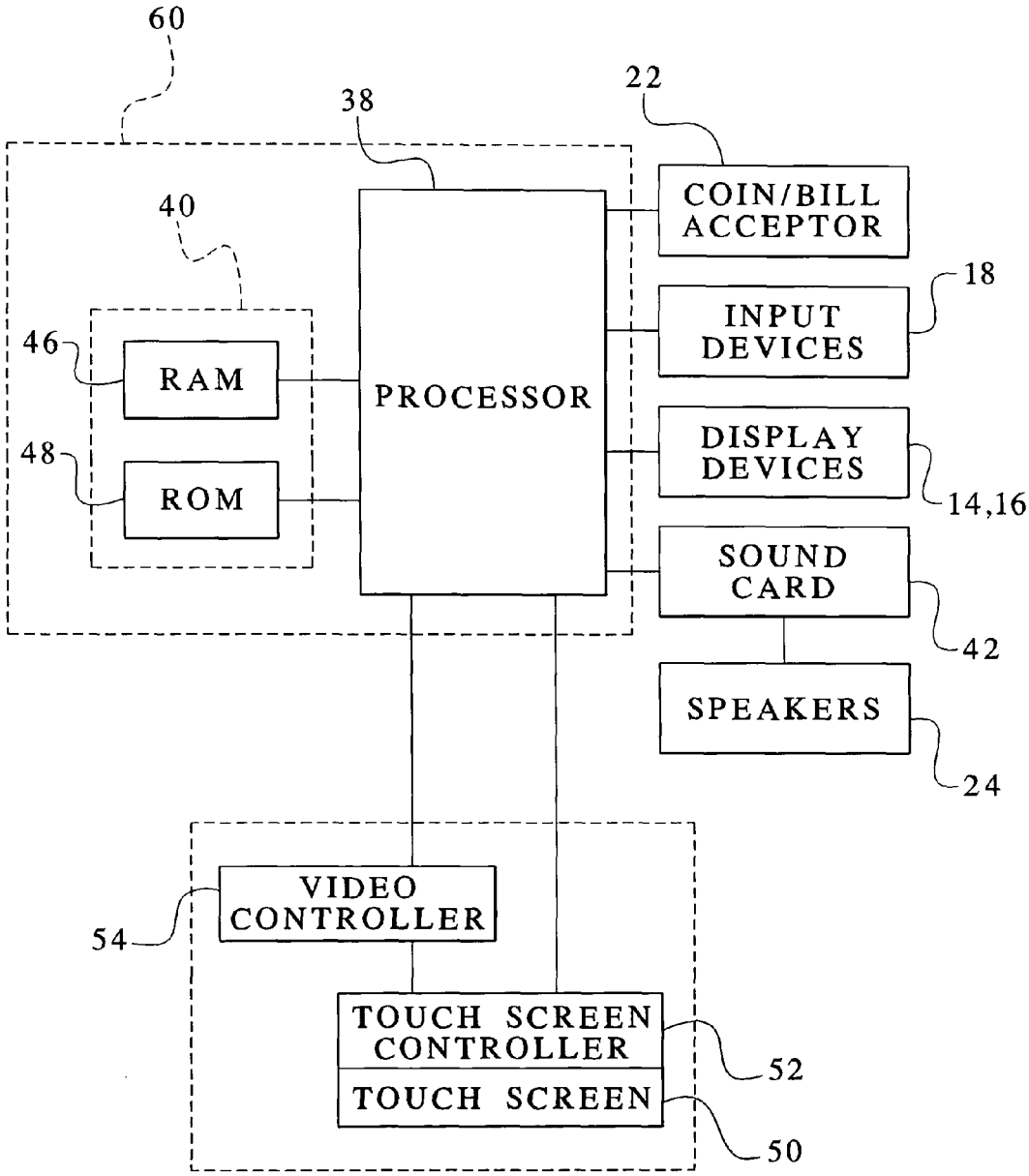
FIG. 2 is an electrical schematic for one embodiment of a gaming device having the lottery type video game.

Referring now to FIG. 2, gaming device 10 is run by a processor or central processing unit ("CPU") 38 and a memory device 40 that operates with one or more display devices 14 and 16 that display the generated Keno numbers. Processor 38 is in one embodiment a microprocessor and has a microcontroller-based platform. The memory device 40 preferably includes random access memory ("RAM") 46 and read only memory ("ROM") 48. The platform for the processor 38 and memory device 40 is located inside the gaming device 10, as a stand alone component in the casino, as part of a client/server system, as part of a data network, as one or more application-specific integrated circuits (ASIC's), and/or as or one or more hard-wired devices.

Gaming device 10 can house its own gaming program and/or be linked in a client/server manner via a data network 60, wherein some or all of the functions of the processor and memory device are provided at a central location, such as a network server for communication to a playing station over a local area network (LAN), wide area network (WAN), Internet connection, microwave link and the like.

Gaming device 10 provides one or more electromechanical input device 18 and/or simulated input devices. The simulated input devices may be provided by a touch screen device 50 that operates via a touch screen controller 52 and a video controller 54 with the processor 38. The input devices (mechanical or virtual) enable the player to operate the Keno gaming device 10. One of the video monitors 14 and 16 and possibly, additionally the speakers 24 are used to explain the operation of and perform the Keno games described herein. Cabinet 12 of gaming device 10 also provides a number of speakers 24 that operate via a soundcard 42 with processor 38 to inform the player of any suitable type of output, outcome or audio instruction of gaming device 10.

In one embodiment, gaming device 10 operates a Keno game as well as one or more other games, such as slots, poker, blackjack, craps or other video wagering games. In one embodiment, the Keno game is displayed on one video monitor 14, while a second game is displayed on the second video monitor 16 or vice versa. Besides providing Keno games, any of the embodiments described herein can be additionally coupled with the one or more games, such as slots, poker, blackjack, craps, bingo, etc. To that end, either monitor 14 or 16 may provide a menu or selections (or some may be electromechanical) that enables the player to choose to play a game from a plurality of different games such as Keno, Lotto, Bingo, slot, poker, blackjack, craps, etc. The Keno game pays out in tokens or coins in one embodiment but can additionally or alternatively payout non-monetary awards or bonus awards, such as free games, a casino beverage or meal, a number of selections from a prize pool, etc.

The number matching game, whether provided in gaming device 10 or as a casino game, can include any suitable variation of the game. For Keno, the game is illustrated in combination with the variation sometimes referred to as "horse race" or Nevada Keno. In that Keno game, one or more players play against the house. A typical Keno game includes eighty different numbers from which the player chooses. With gaming device 10, the player picks numbers via electromechanical input devices 18 or via the touch screen device 50. In the casino version, the player circles or marks one or more numbers on a casino card. The player decides which and how many numbers to select or pick, usually anywhere from one to fifteen numbers in casino play and one to ten numbers for play on the gaming device 10. However, any suitable number of player selections may be allowed.

In the live casino version, the player brings a marked card to a Keno clerk. The clerk records the player's numbers and issues a receipt to the player. The player finds a Keno monitor and watches the numbers being posted as they are chosen. As the player watches the generation of the Keno numbers, the player marks the generated numbers on the card. For an eighty number game of Keno, twenty numbers may be generated. Either the player's numbers or the game generated numbers may be weighted as described below, wherein the house pays the player based on points or percentages accumulated for example based on matched numbers. Also, the house may from time to time designate a drawn number as a bonus number and provide the player a bonus if the player has picked a matching number.

Figure 3:
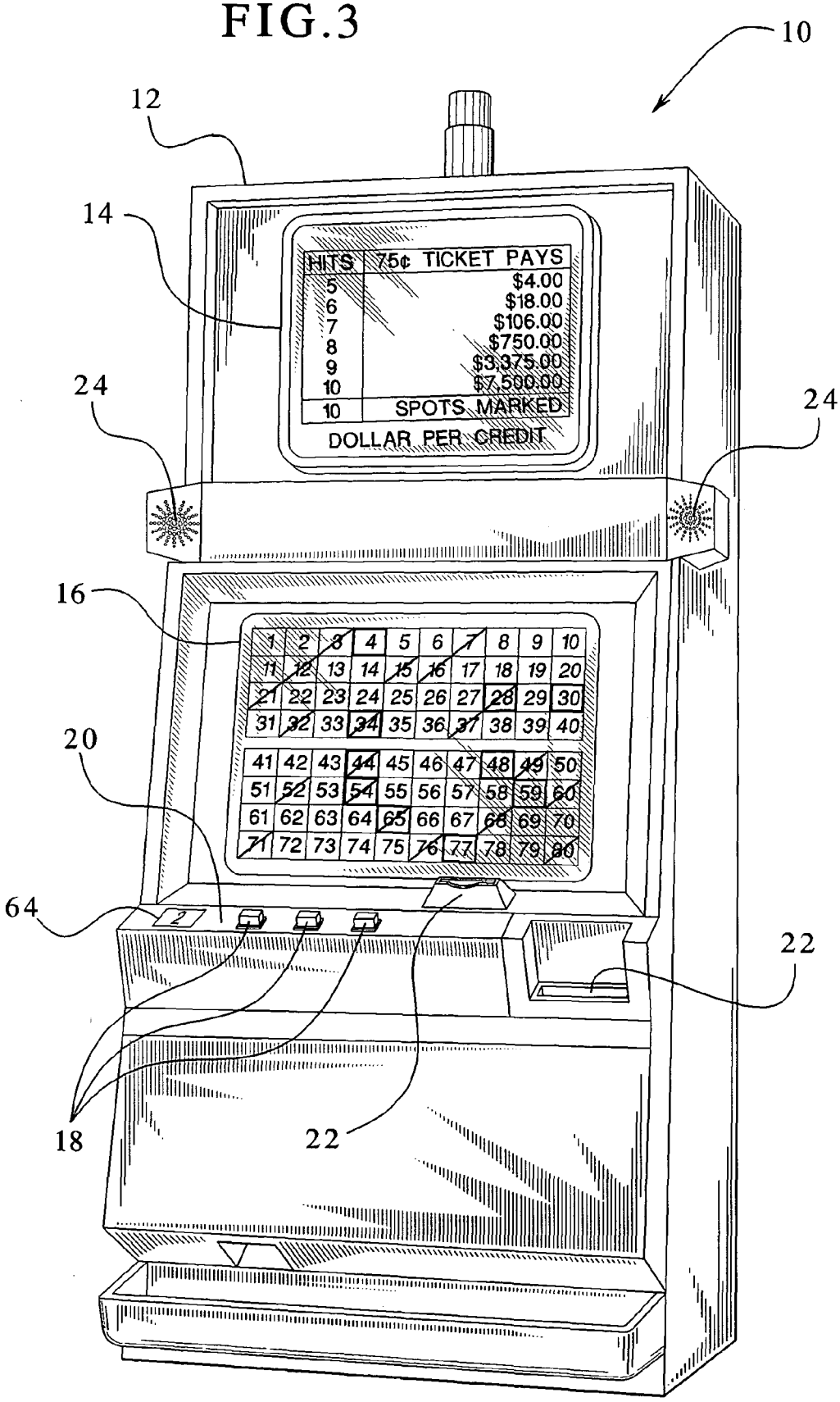
FIG. 3 is a perspective view of a gaming device having an example Keno game display.

FIGS. 1 and 3 illustrate an operation of a known Keno game. FIG. 1 illustrates a fresh screen on the second video monitor 16 with eighty numbers as they appear before the player has made any picks and before the game has shown any drawn numbers. FIG. 3 illustrates the same screen 16 with a completed Keno game. In this example, the player has pressed one of the electromechanical pushbuttons 18 or has touched the touch screen 50 that operates with display device 16 to select or pick ten numbers 4, 28, 30, 34, 44, 48, 54, 59, 65 and 77. Alternatively, the player presses an input that autopicks numbers for the player. The term "player's picks" and "selected player picks" expressly include the player's selection of individual numbers as well the generation of picks for the player via the autopicks function. The player's picks are shown in FIG. 3 as bolded and bordered. In the example illustrated, gaming device 10 has randomly generated or drawn twenty numbers 3, 7, 12, 15, 16, 21, 28, 32, 34, 37, 44, 49, 52, 54, 60, 65, 68, 71, 64 and 80. The drawn numbers are shown with a cross-out mark.

In some embodiments, the drawn numbers are not random. Instead, a random (or pseudo-random) number is generated by the gaming device and/or a central controller to determine a game outcome (e.g., lose, win five credits, win ten credits, etc.). Then, based on the game outcome, the gaming device and/or the central controller selects an appropriate number of matches to correspond to the outcome (e.g., select three matching numbers and seven non-matching numbers).

Regardless of how the draw numbers are determined, the gaming device displays the matches (if any). There are five matches shown in FIG. 3, namely, numbers 28, 34, 44, 54 and 65 (bearing both markings). According to the paytable displayed in display device 14, gaming device 10 pays $4.00 on a one dollar bet for five matches or hits, in this case for ten player picks. Keno payouts can vary. For example, if the player picks five numbers, the Keno game can require that the random generation device draw two of those five numbers for the player to receive any award or three of those five numbers for the player to receive any award. If the Keno game draws three matches, the Keno game can pay the player back at three to one, 2.5 to one, 3.5 to one, etc.

Figure 4:
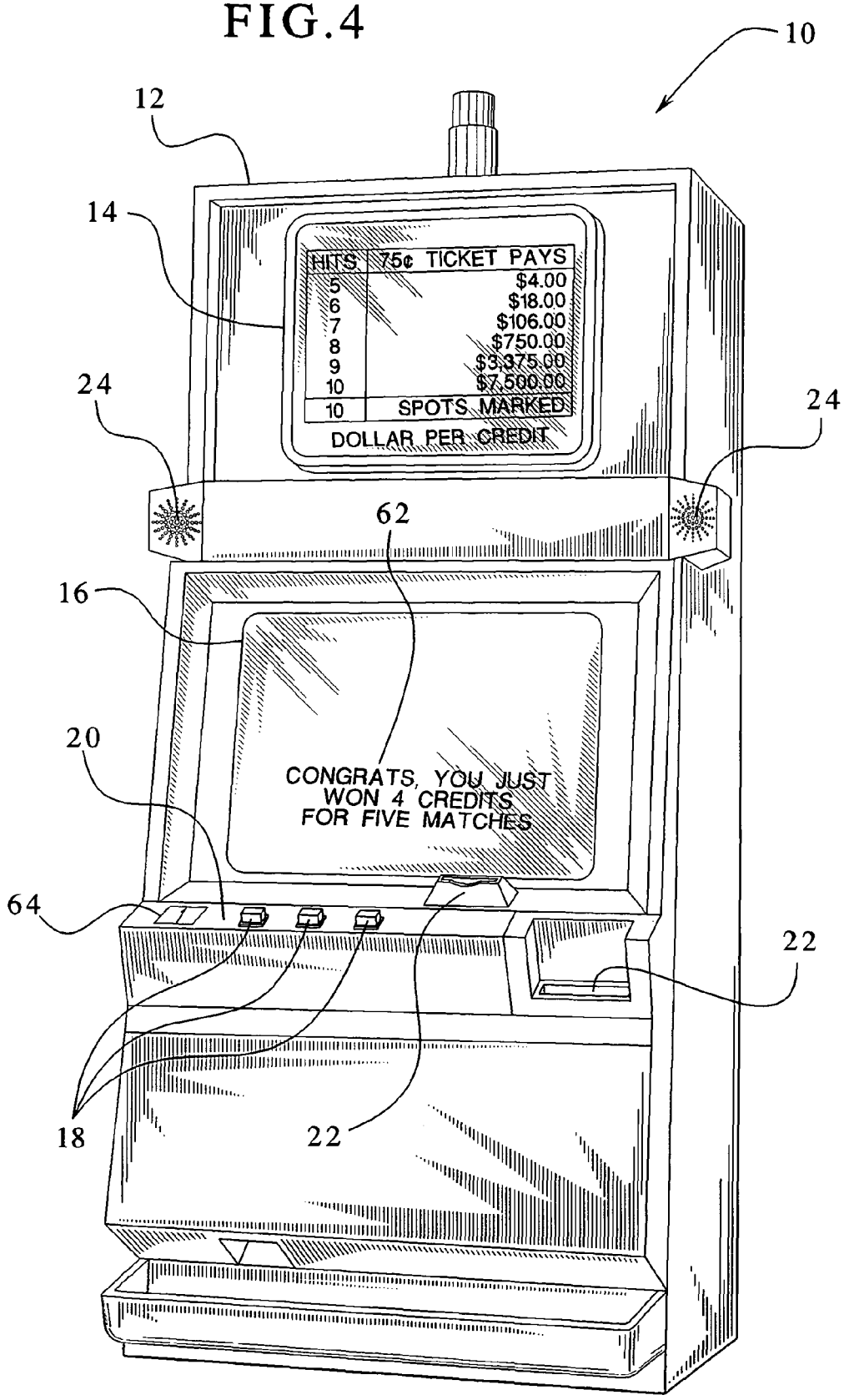
FIG. 4 is another perspective view of a gaming device having an example Keno game display.

Typically, an equal weight is assigned to each number picked by the player and each number drawn by the Keno game. The number of matches determines the player's award independent of which numbers are matched. The award, if any, depends on the percentage of the player's picks that are also generated randomly by gaming device 10 or the house. In FIG. 1, for example, the player starts with three credits as seen in credit meter 64. The game costs one dollar to play. FIG. 3 illustrates that the player has played one game, decreasing the player's credits to two as seen in credit meter 64. FIG. 4 illustrates via message 62 and credit meter 64 that the gaming device 10 has paid the player four credits for obtaining five matches, increasing the total to six. In the live casino version, if the player has enough matches to claim a winning ticket, which depends on how many numbers the player has selected, the player returns to the Keno clerk to redeem the winning ticket.

The gaming system disclosed herein enables a player to select a plurality of numbers (or other symbols or selections) displayed by a gaming machine (e.g., a Keno game), and the amount of the player's wager is automatically determined by the gaming machine based on how many numbers (or other symbols or selections) the player selects. For example, one credit may be automatically wagered by the gaming machine for each player selection. In another example, the player may be allowed to pick a predetermined quantity of numbers (e.g., three Keno spots) for a first number of credits wagered (e.g., one credit) and then additional numbers (e.g., up to seven more Keno spots) for a second number of credits wagered (e.g., one credit for each additional selection).

When the player completes the selections (or during the selections) the gaming machine randomly (or pseudo randomly) selects a winning set of numbers and displays how many matches occurred between the gaming machine selected numbers and the player selected numbers. If a predetermined minimum number of matches occurs, the player is awarded a predetermined number of credits, which may be less than the number of credits automatically wagered.

Figure 5:
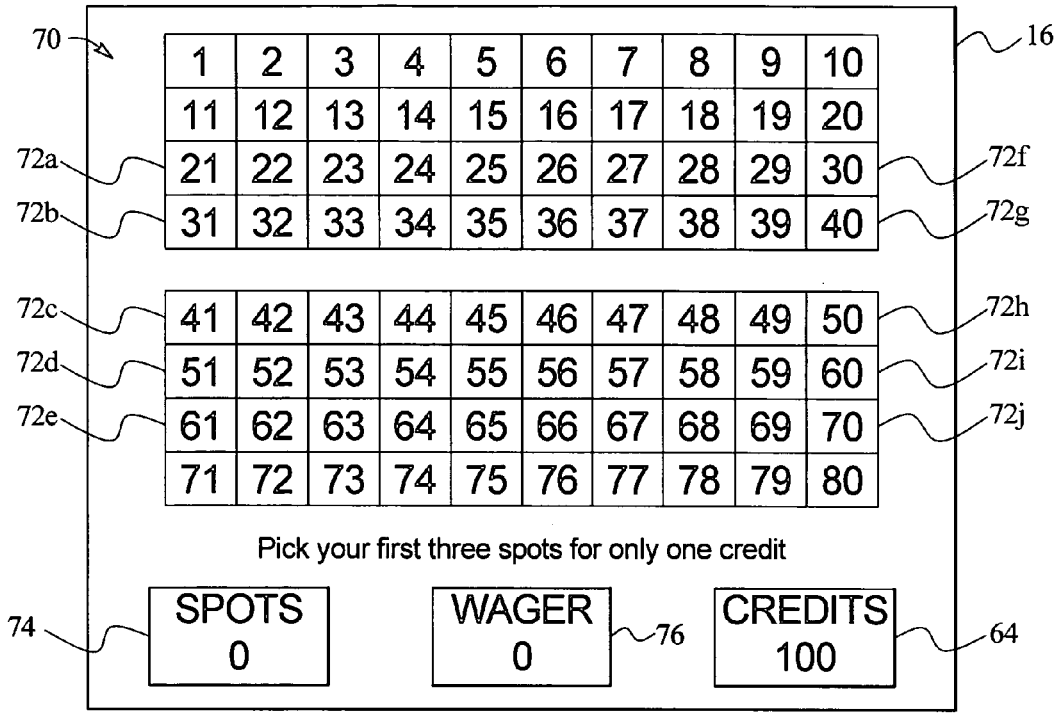
FIG. 5 is an example display for an electronic Keno game having cost per pick based wagering wherein no spots are selected and one hundred credits are available.

Turning now to FIGS. 5 to 16, a description of a Keno game having cost per pick based wagering is illustrated. FIG. 5 illustrates an example electronic Keno board 70 shown by the display 16. Generally, the Keno board 70 includes a plurality of numbered squares 72, ten examples of which are designated 72*a*, 72*b*, 72*c*, 72*d*, 72*e*, 72*f*, 72*g*, 72*h*, 72*i* and 72*j*. Although eighty numbered squares are used throughout the examples herein, it should be appreciated that any suitable number and any suitable type of symbol, image or indicia may be used. For example, any suitable number of letters and/or pictures may be used.

Each numbered square 72 represents a potential selection for a player and a potential winning number for a game. Generally, the player selects from one to ten squares 72 by pressing on the squares via the touch-screen device 50. Although the player selects ten numbered squares 72 in this example, it should be appreciated that any number of numbered squares 72 may be allowed by the game. For example, the player may stop after selecting five numbered squares 72 one game and after selecting three numbered squares 72 the next game.

In addition, any suitable method of selecting the squares 72 may be used. For example, the player may enter a number on a keypad to select that number. Similarly, a player may press a button on the gaming device 10 to have a random number generator automatically select a predetermined number of squares 72. In one embodiment, the player indicates the wager amount (e.g., five credits), and then the gaming device 72 automatically selects (i.e. quick picks) a quantity of squares based on the wager amount (e.g., five squares).

Figure 6:
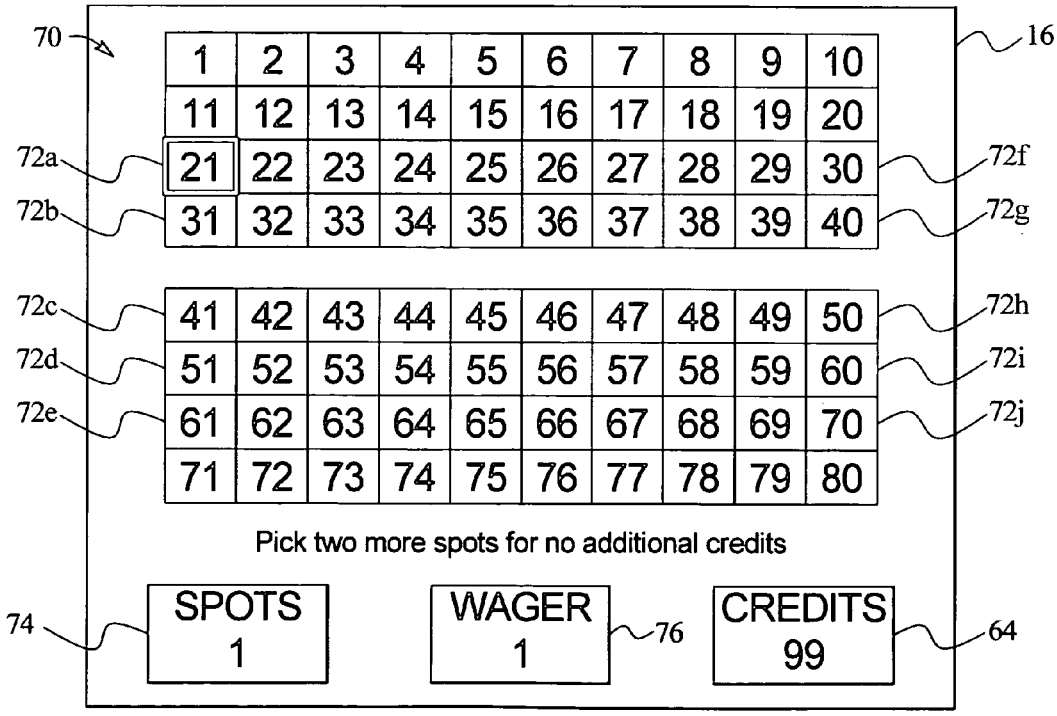
FIG. 6 is the example display of FIG. 5 wherein a first spot is selected and one credit is wagered.

Regardless of how the squares 72 are selected, the gaming device 10 preferably indicates the selected squares visually. For example, a selected square 72*a* may be displayed with a bold border surrounding the selected square as shown in FIG. 6.

In the illustrated example, the Keno board 70 also includes a spot meter 74, a wager meter 76, and a credit meter 64. The spot meter 74 indicates how many of the numbered squares 72 are currently selected. The wager meter indicates the number of credits currently being wagered. The credit meter 64 indicates how many credits the player currently has in the gaming device 10. For example, in FIG. 5, the player is starting a new game, therefore zero spots are currently selected. As shown in FIG. 6, when the player selects square 72*a*, the bold border is drawn around the selected square 72*a*, the number in the spot meter 74 is increased from zero to one, the number in the wager meter 76 is increased from zero to one, and the number in the credit meter 64 is decreased from one-hundred to ninety-nine.

Figure 7:
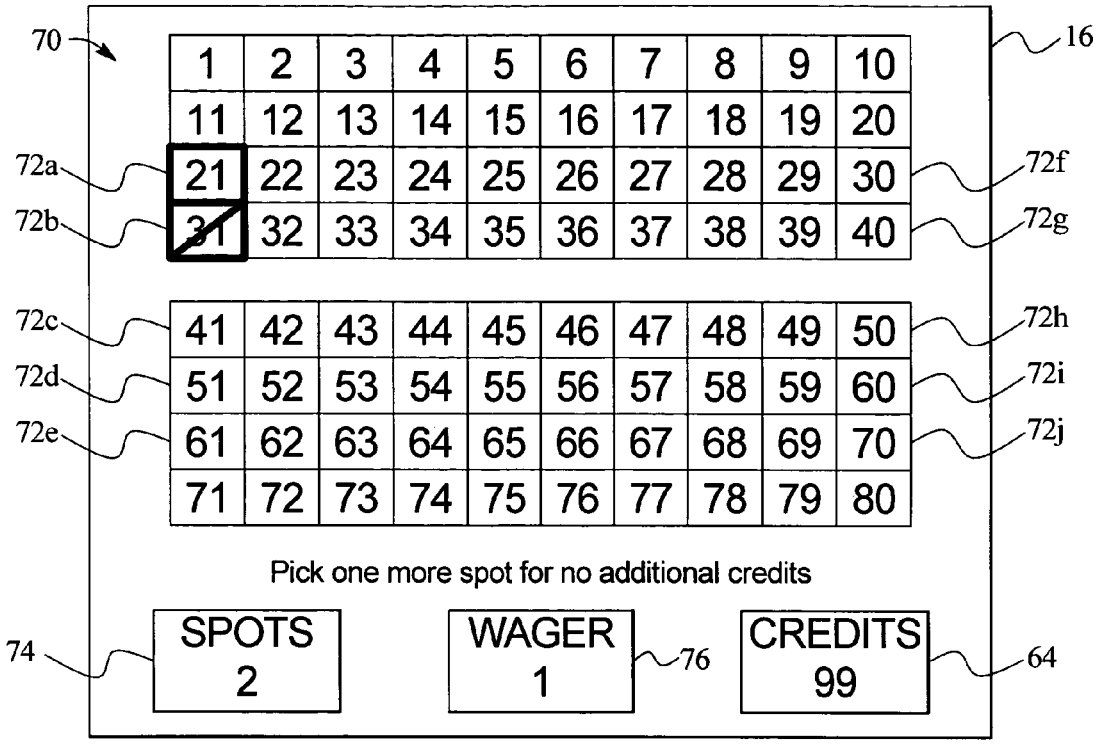
FIG. 7 is the example display of FIG. 6 wherein a second spot is selected, but no additional credits are wagered.

Continuing the example to FIG. 7, when the player selects a second square 72*b*, another bold border is drawn on square 72*b*. This selection also shows a cross-out mark through the selected square 72*b*. The cross-out mark indicates that this selection resulted in a match. In an alternate embodiment, the gaming device 10 waits until the player is finished selecting numbers before revealing which selections are matches. Due to this second selection, the number in the spot meter 74 is increased from one to two. However, the number in the wager meter 76 is not increased, and the number in the credit meter 64 is not decreased. Instead, in this example, the player is given three picks for the initial credit already deducted from the player's account.

Figure 8:
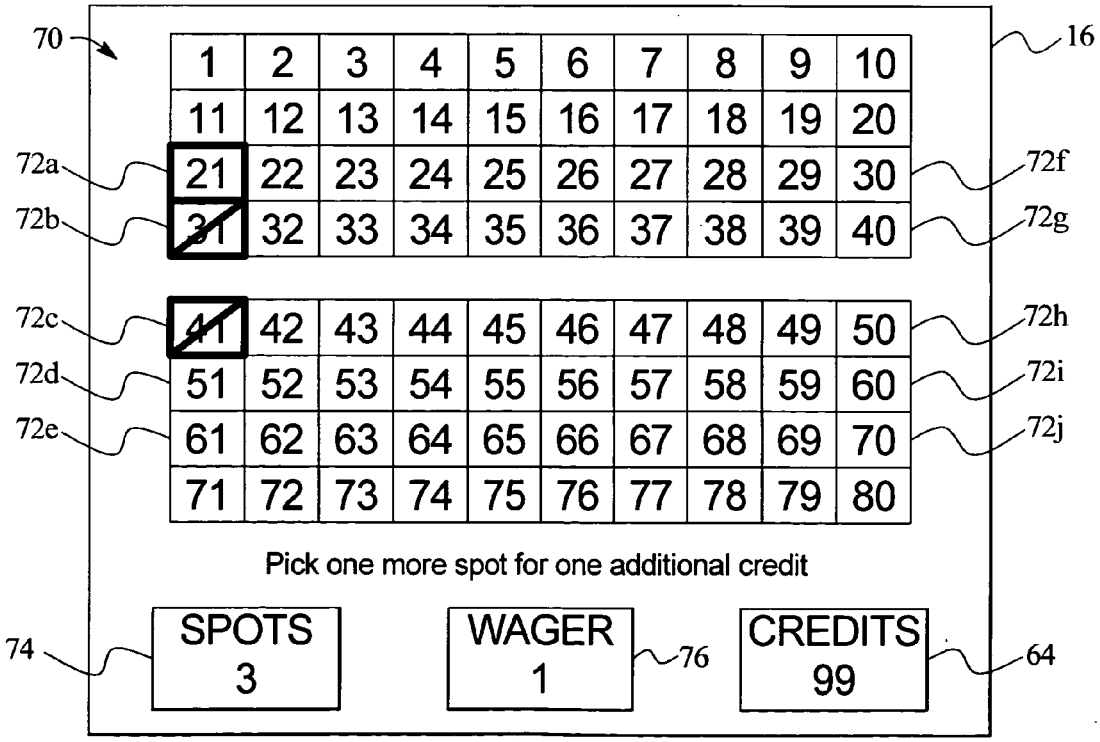
FIG. 8 is the example display of FIG. 7 wherein a third spot is selected, but still no additional credits are wagered.

Continuing the example to FIG. 8, when the player selects a third square 72*c*, another bold border is drawn on square 72*c*. Again, in this example, the selection results in a cross-out mark through the selected square 72*c* indicating that this selection resulted in a match. Due to this third selection, the number in the spot meter 74 is increased from two to three. However, the number in the wager meter 76 is still not increased, and the number in the credit meter 64 is still not decreased.

Figure 9:
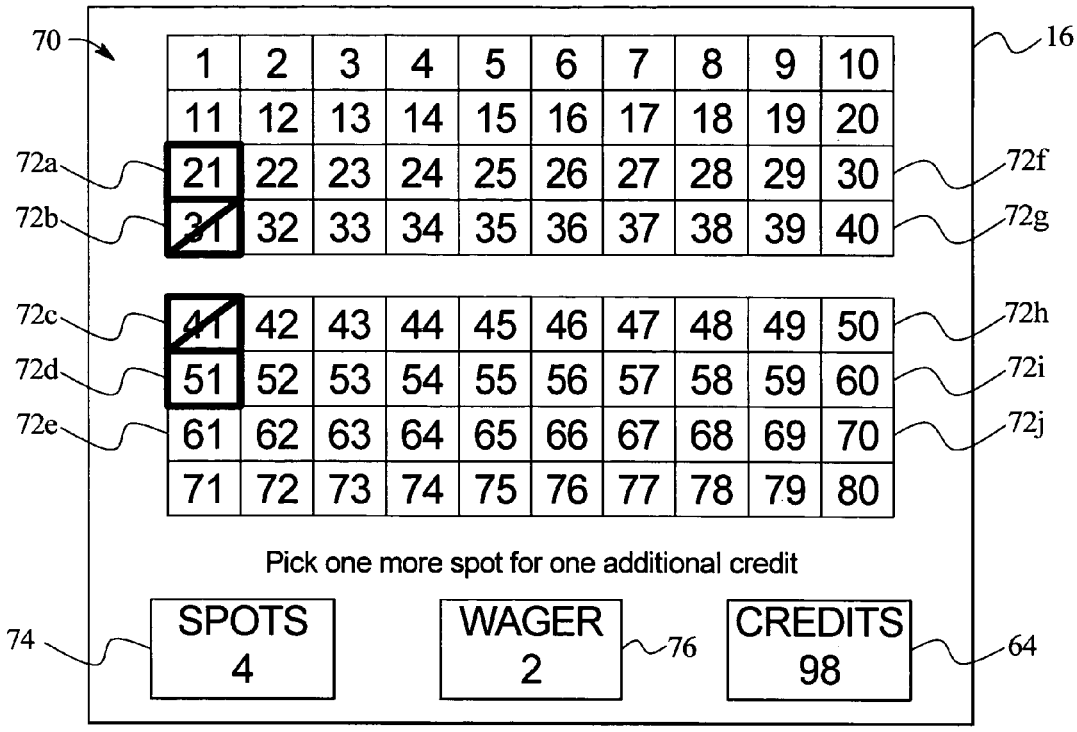
FIG. 9 is the example display of FIG. 8 wherein a fourth spot is selected, and a second credit is wagered.

Continuing the example to FIG. 9, when the player selects a fourth square 72*d*, another bold border is drawn on square 72*d*. This selection does not result in a cross-out mark through the selected square 72*d*. In other words, this selection is not a match. Due to this fourth selection, the number in the spot meter 74 is increased from three to four. In addition, the number in the wager meter 76 is increased from one to two, and the number in the credit meter 64 is decreased from ninety-nine to ninety-eight.

Figure 10:
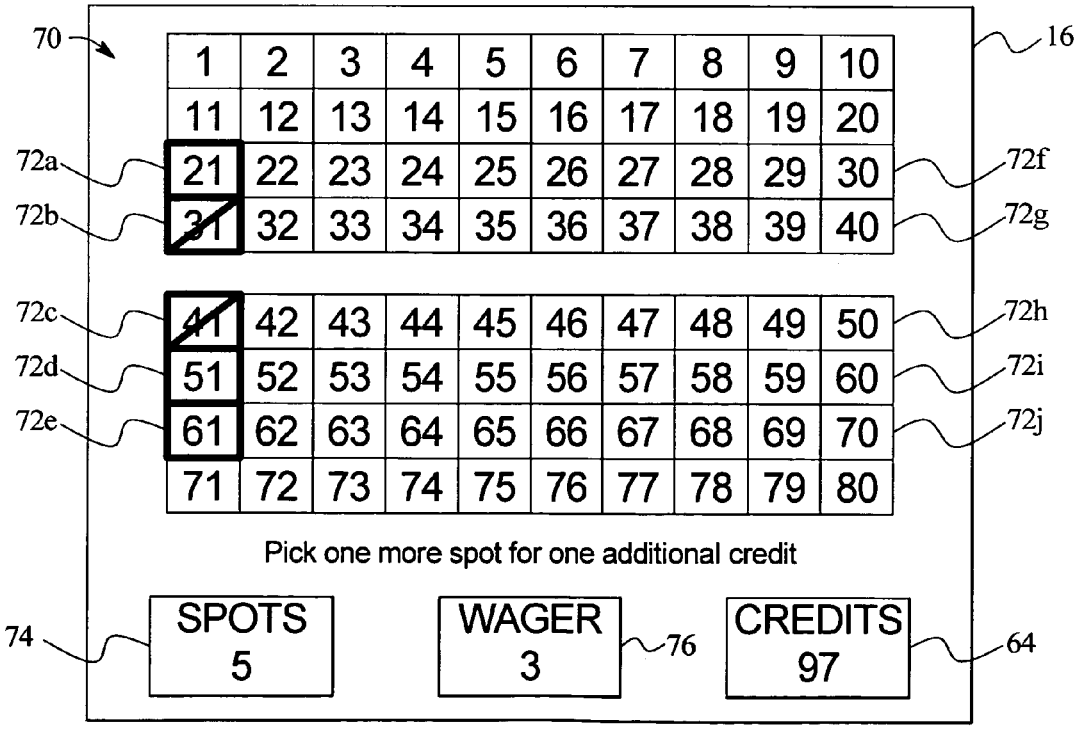
FIG. 10 is the example display of FIG. 9 wherein a fifth spot is selected, and a third credit is wagered.

Continuing the example to FIG. 10, when the player selects a fifth square 72*e*, another bold border is drawn on square 72*e*. Again, this selection does not result in a cross-out mark through the selected square 72*e*. (i.e., no match). Due to this fifth selection, the number in the spot meter 74 is increased from four to five. In addition, the number in the wager meter 76 is increased from two to three, and the number in the credit meter 64 is decreased from ninety-eight to ninety-seven.

Figure 11:
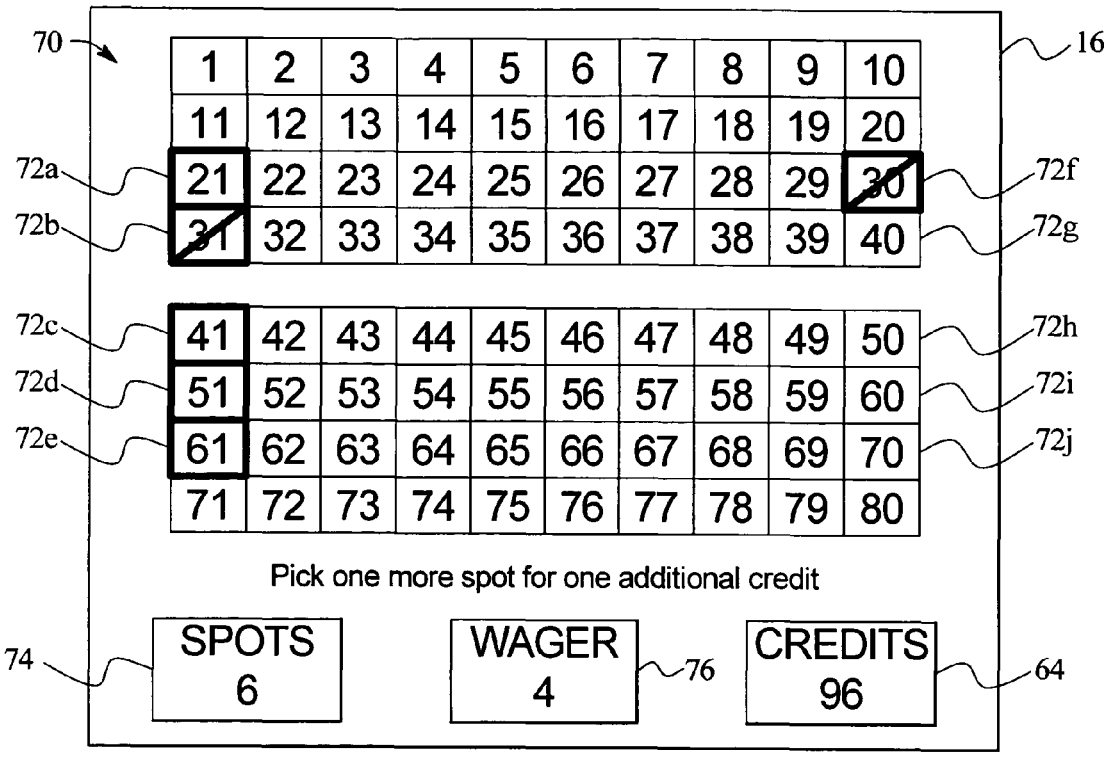
FIG. 11 is the example display of FIG. 10 wherein a sixth spot is selected, and a fourth credit is wagered.

Continuing the example to FIG. 11, when the player selects a sixth square 72*f*, another bold border is drawn on square 72*f*. This selection does result in a cross-out mark through the selected square 72*f*. (i.e., a match). Due to this sixth selection, the number in the spot meter 74 is increased from five to six. In addition, the number in the wager meter 76 is increased from three to four, and the number in the credit meter 64 is decreased from ninety-seven to ninety-six.

Figure 12:
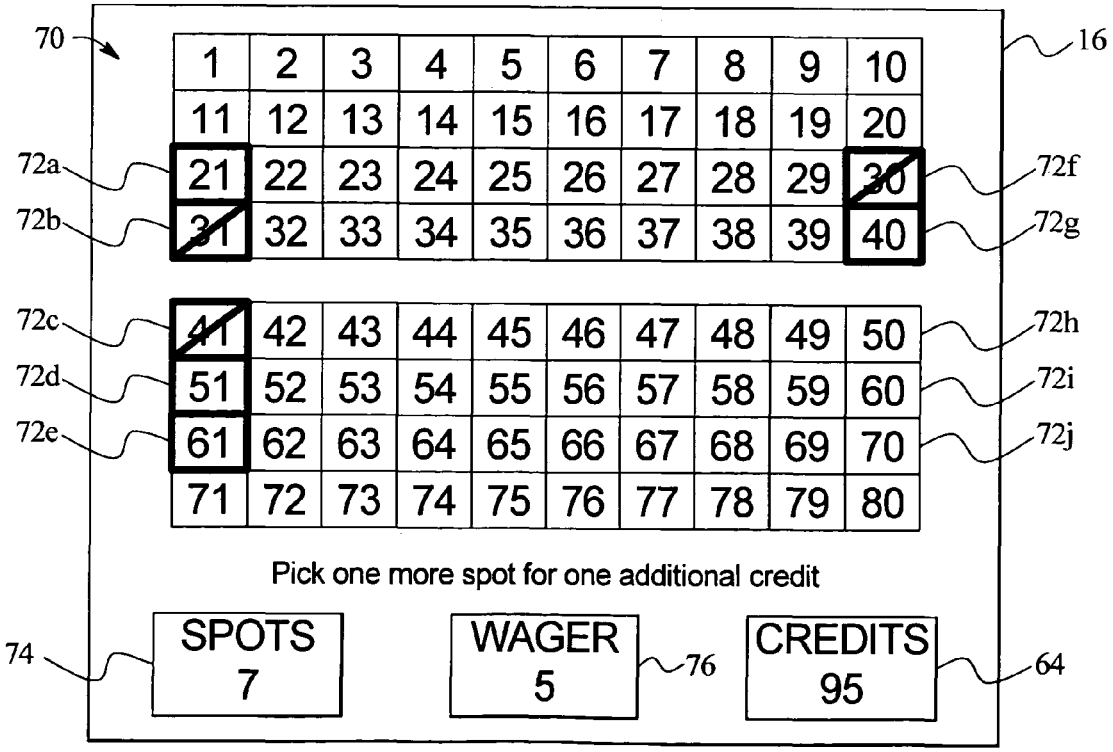
FIG. 12 is the example display of FIG. 11 wherein a seventh spot is selected, and a fifth credit is wagered.

Continuing the example to FIG. 12, when the player selects a seventh square 72*g*, another bold border is drawn on square 72*g*. This selection does not result in a cross-out mark through the selected square 72*g*. (i.e., no match). Due to this seventh selection, the number in the spot meter 74 is increased from six to seven. In addition, the number in the wager meter 76 is increased from four to five, and the number in the credit meter 64 is decreased from ninety-six to ninety-five.

Figure 13:
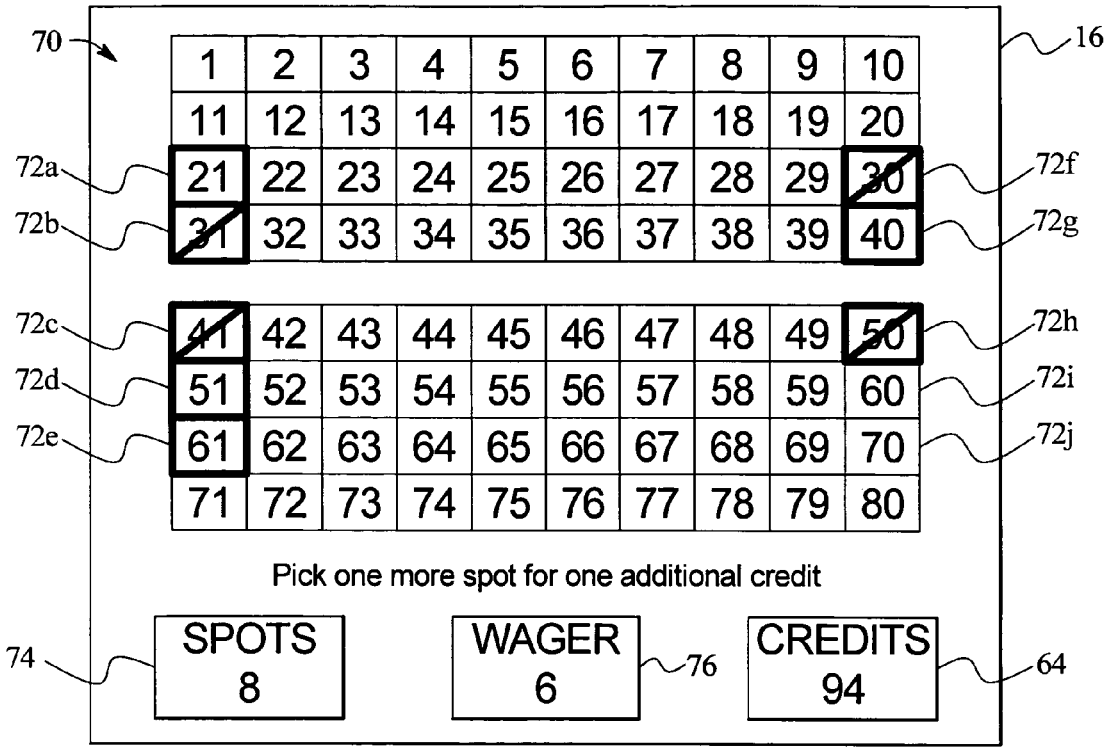
FIG. 13 is the example display of FIG. 12 wherein a eight spot is selected, and a sixth credit is wagered.

Continuing the example to FIG. 13, when the player selects a eighth square 72*h*, another bold border is drawn on square 72*h*. This selection does result in a cross-out mark through the selected square 72*h*. (i.e., a match). Due to this eighth selection, the number in the spot meter 74 is increased from seven to eight. In addition, the number in the wager meter 76 is increased from five to six, and the number in the credit meter 64 is decreased from ninety-five to ninety-four.

Figure 14:
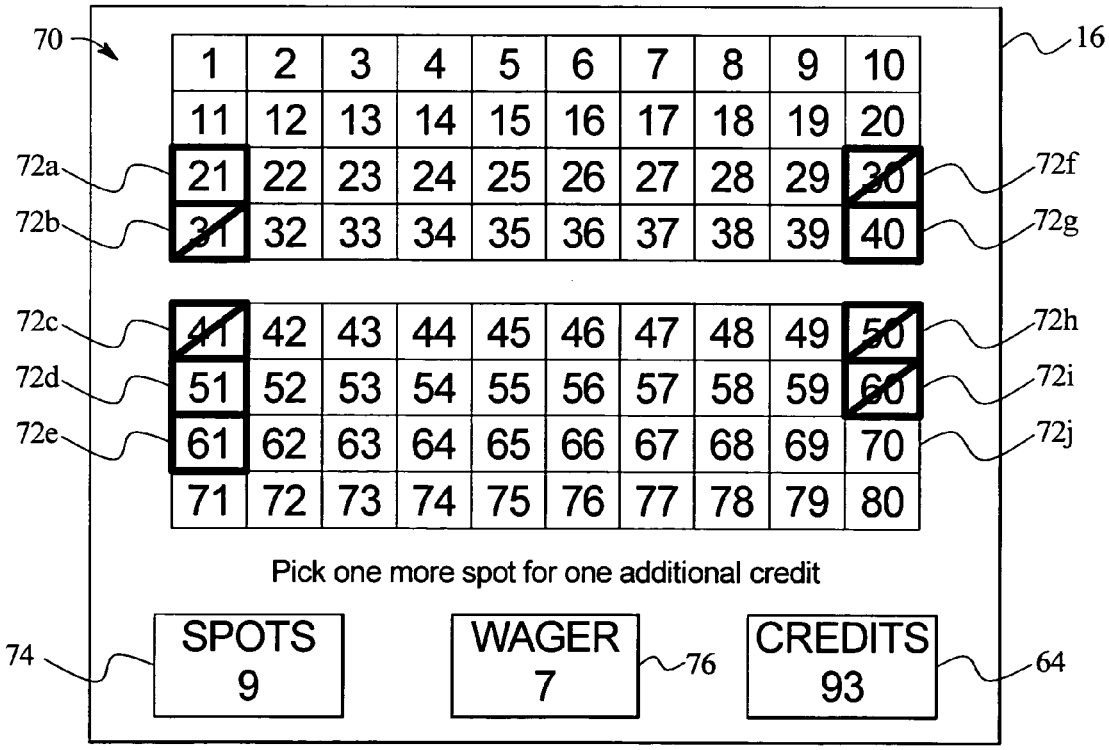
FIG. 14 is the example display of FIG. 13 wherein a ninth spot is selected, and a seventh credit is wagered.

Continuing the example to FIG. 14, when the player selects a ninth square 72*i*, another bold border is drawn on square 72*i*. This selection also results in a cross-out mark through the selected square 72*i*. (i.e., a match). Due to this ninth selection, the number in the spot meter 74 is increased from eight to nine. In addition, the number in the wager meter 76 is increased from six to seven, and the number in the credit meter 64 is decreased from ninety-four to ninety-three.

Figure 15:
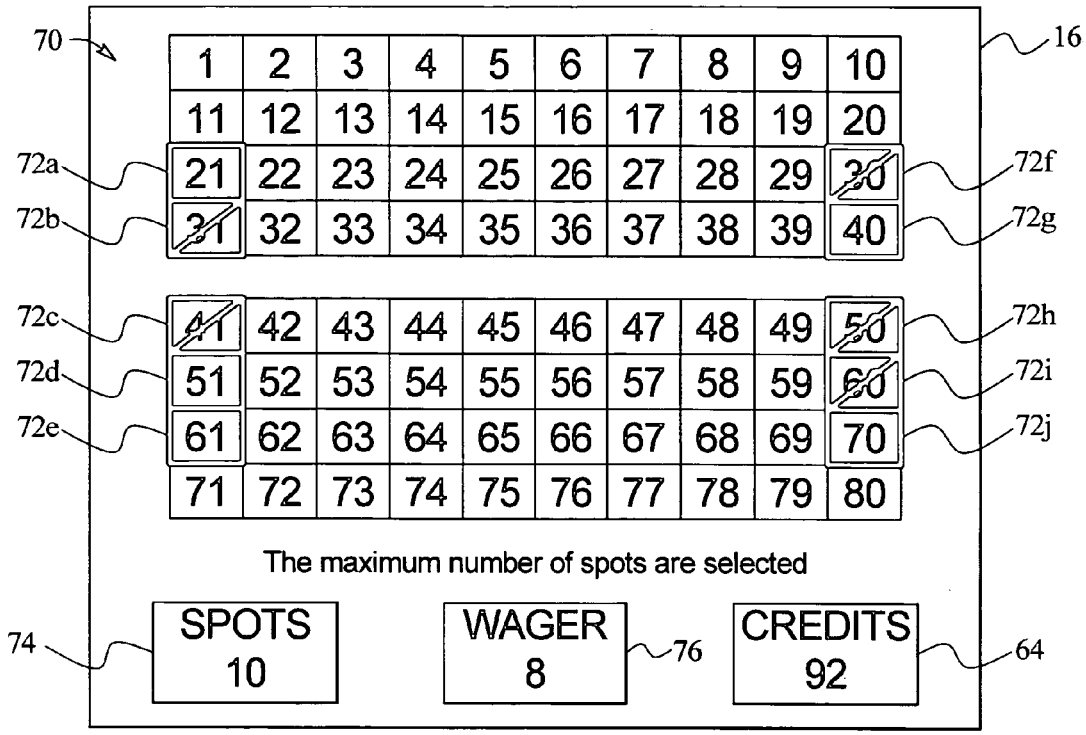
FIG. 15 is the example display of FIG. 14 wherein a tenth spot is selected, and a eighth credit is wagered.

Finally, continuing the example to FIG. 15, when the player selects a tenth square 72*j*, another bold border is drawn on square 72*j*. This selection does not result in a cross-out mark through the selected square 72*j*. (i.e., no match). Due to this tenth selection, the number in the spot meter 74 is increased from nine to ten. In addition, the number in the wager meter 76 is increased from seven to eight, and the number in the credit meter 64 is decreased from ninety-three to ninety-two.

Figure 16:
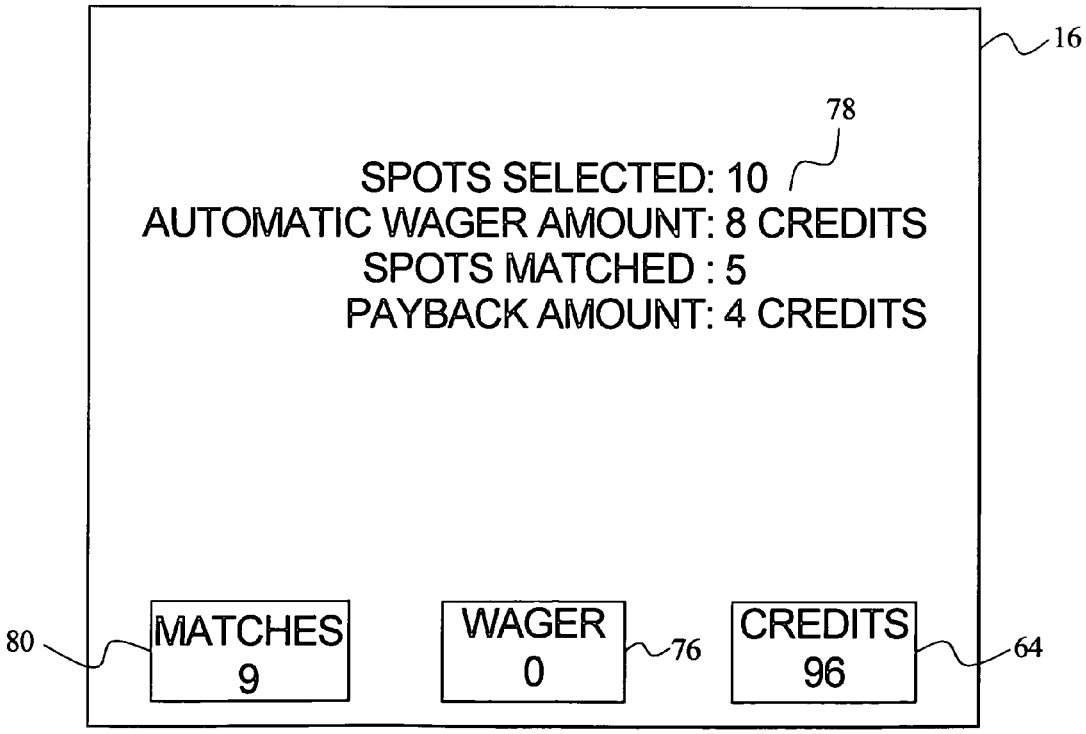
FIG. 16 is an example display for an electronic Keno game having cost per pick based wagering wherein a congratulations message is displayed.

In this example, the player is awarded four credits for making five matches as shown by the summary message 78 of FIG. 16. A match meter 80 is also shown in this example. The match meter 80 indicates the number of matches between the player selected squares 72 and a number of squares (e.g., twenty) that are randomly selected. The randomly selected numbers may be determined mechanically (e.g., via jumbled balls with numbers) and/or electronically (e.g., via a computing device with a random number generator).

Although the player in this example wagered eight credits in order to win four credits (for a net loss of four credits), the player may receive some sense of satisfaction from the four credit "win." By using the cost per pick based wagering scheme, and allowing the number of credits awarded to be less than the amount the player wagered, a new Keno game with a higher "win" frequency is provided. By providing the player with more game plays that include some amount of payback, the Keno game becomes more enjoyable, fun and exciting.

Figure 17:
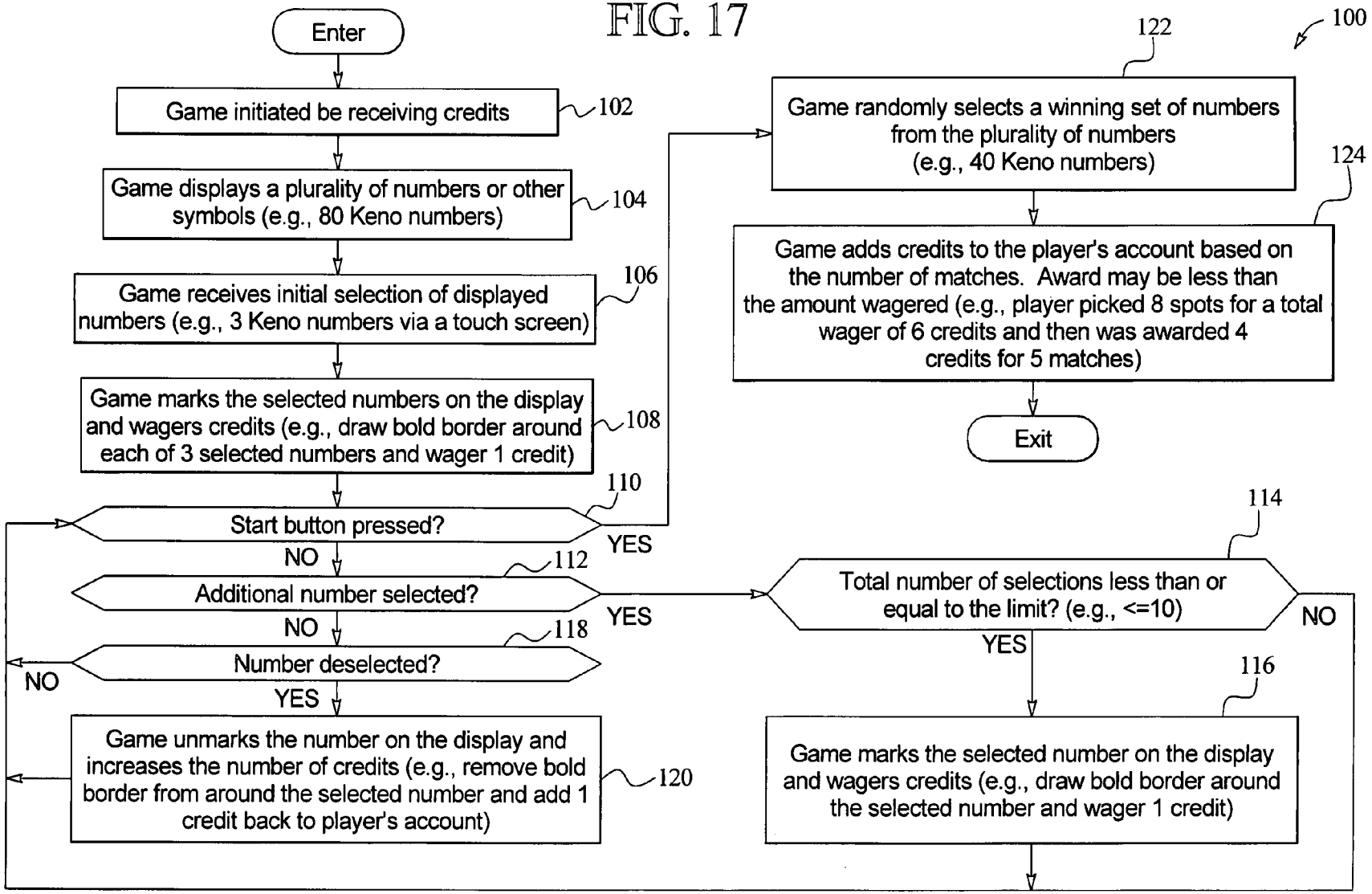
FIG. 17 is a schematic block diagram illustrating an example of the disclosed system wherein an amount of a wager is based on a number of Keno spots selected by a player and wherein an award given to the player may be less than the amount wagered.

FIG. 17 is a schematic block diagram illustrating an example of the disclosed cost per pick system. Preferably, the system is embodied in one or more software programs which are stored in one or more memories 40 and executed by one or more processors 38. Although the system is described with reference to the schematic block diagram illustrated in FIG. 17, it should be appreciated that many other suitable methods of performing the acts associated with system may be used. For example, the order of many of the operations may be changed. In addition, many of the operations described are optional. In addition, although the examples used herein are directed to a Keno game, it should be appreciated that the techniques disclosed herein may be applied to other types of games.

Generally, the system described in FIG. 17 enables a player to select a plurality of numbers displayed on a Keno game. In this example, the amount of the player's wager is based on how many Keno spots the player selects. When the player completes the selections (or during the selections) the Keno game randomly selects a winning set of numbers and displays how many matches occurred between the randomly selected numbers and the player selected numbers. If a predetermined minimum number of matches occurs, the player is awarded a predetermined number of credits. The number of credits awarded may be less than the amount the player wagered.

In this example, a Keno game is started when a player deposits one or more credits into the gaming device 10 as indicated by block 102. For example, the player may insert one or more coins or bills into the gaming device 10. Alternatively, the player may insert a credit or debit card into the gaming device 10. In any event, the gaming device 10 preferably displays the number of credits deposited in the credit meter 64.

During game play, the gaming device 10 displays a plurality of numbered squares or other symbols as indicated by block 104. For example, the numbers one through eighty may be displayed in a grid as shown in FIGS. 1, 3, and 5 to 15. However, it should be appreciated that any suitable number and any suitable type of symbol, image or indicia may be used. For example, any suitable number of letters and/or pictures may be used.

The gaming device 10 then enables the player to select an initial set of the displayed numbers as indicated by block 106. For example, the player may select three different Keno numbers via an electromechanical pushbutton and/or the touch screen device 50. The gaming device 10 then modifies the displayed plurality of numbered squares by marking the squares associated with each of the selected numbers as indicated by block 108. For example, each of the selected squares my be drawn with a bold border as shown in FIGS. 5 to 15. In addition, the gaming device 10 increases the number of credits in the wager meter 76 and decreases the number of credits in the credit meter 64 as indicated by block 108. In this example, the initial set of three picks costs the player one credit.

After the player selects the initial set of numbers, the player may press a start button or perform some other action to see if any matches occurred. Alternatively, matches may be reveled as the player selects the numbers. In either case, the player may go on to select additional numbers. In the embodiment that includes a start button, the gaming device 10 determines if the start button is pressed as indicated by block 110. If the start button is not pressed, the gaming device 10 determines if the player selected an additional number as indicated by block 112.

If the player selects an additional number, the gaming device 10 determines if the total number of selections is less than or equal to a predetermined limit on the number of selections as indicated by block 114. For example, the player may be limited to ten total selections per game. If the total number of selections is less than or equal to the predetermined limit, the gaming device 10 marks the selected number on the display and reduces the number of credits in the player's account as indicated by block 116. For example, the gaming device 10 may draw a bold box around the selected number and deduct one credit form the player's account.

If the total number of selections is greater than the predetermined limit, the gaming device 10 does not mark the selected number on the display or reduce the number of credits in the player's account. For example, if the player attempts to select an eleventh number on a gaming device 10 that is limited to ten selections per game, the gaming device 10 may issue a warning message, show a help screen, automatically start the game with the ten previous selections, etc. In the example illustrated in FIG. 17, the gaming device simply waits for the player to press the start button as indicated by block 110 or for the player to deselect an existing number as indicated by block 118.

If the player deselects a number, the gaming device unmarks the number and may increase the number of credits in the player's account as indicated by block 120. For example, if the player currently has four numbers selected, and the player touches one of the four selected numbers on the touch screen device 50, the gaming device 10 preferably removes the bold border from around the deselected number and adds one credit to the player's account. Similarly, if the player currently has three numbers selected, and the player touches one of the three selected numbers on the touch screen device 50, the gaming device 10 preferably removes the bold border from around the deselected number. However, when going from three selected numbers down to two selected numbers, the gaming device does not add a credit to the player's account because, in this example, the initial set of three picks was given to the player for one credit.

When the player finishes selecting his numbers, the gaming device 10 randomly selects a winning set of numbers from the plurality of displayed numbers as indicated by block 122. For example, the gaming device may randomly select twenty Keno numbers from a possible eighty Keno numbers. It will be appreciated that any quantity of possible numbers and selections may be used (e.g., forty selections and/or one-hundred possible numbers). Alternatively, the gaming device 10 or a central server may randomly select the winning numbers prior to and/or during the player selections. Preferably, a predetermined range of random numbers corresponds to a single predetermined outcome.

If the player achieves a predetermined minimum number of matches or points, the gaming device 10 then adds a number of credits to the player's account. As described in detail below with reference to the example pay tables of FIGS. 18 to 25, the awarded credits may be less than the amount wagered.

The Keno game associated with each of the pay table examples illustrated in FIGS. 18 to 25 is a point based Keno game. In this example Keno game, eighty numbers are displayed. The player may choose from three to ten of the eighty numbers. The Keno game then randomly selects forty of the eighty numbers. Each of the numbers randomly selected by the Keno game (i.e., the draws) is associated with a point value by the Keno game. The player accumulates points for each matching number (i.e., each hit). The player's award (if any) is based on the number of points accumulated.

As described above, the player may be allowed to select an initial number of spots for an initial wager, and then the player may select additional spots for a corresponding increase in the wager. For example, the player may be allowed to select three spots for an initial wager of one credit and then an additional spot for each additional credit up to a total of ten spots for eight credits. Each of these potential wagers (e.g., 3 spots for 1 credit, 4 spots for 2 credits, 5 spots for 3 credits, 6 spots for 4 credits, 7 spots for 5 credits, 8 spots for 6 credits, 9 spots for 7 credits, and 10 spots for 8 credits) is preferably associated with a different pay table.

An example of a pay table associated with a Keno game in which the player selects three spots for a wager of one credit is illustrated in FIG. 18. In this example, the maximum number of points the player can earn is thirty points. If the player earns all thirty points, the player is awarded one-hundred credits. According to this pay table, the odds of earning all thirty points are 1/4108. If the player earns from twenty-two to twenty-nine points, the player is awarded nineteen credits. According to this pay table, the odds of earning from twenty-two to twenty-nine points are 1/304.3. Other points totals result in other awards as shown in the table of FIG. 18. The smallest award of one credit is given for earning from five to ten points. In this example, the player would break even for earning form five to ten points (i.e., one credit awarded and one credit wagered).

An example of a pay table associated with a Keno game in which the player selects four spots for a wager of two credits is illustrated in FIG. 19. In this example, the maximum number of points the player can earn is forty points. If the player earns from thirty-five to forty points, the player is awarded three-hundred credits. According to this pay table, the odds of earning from thirty-five to forty points are 1/9037.6. If the player earns from thirty to thirty-four points, the player is awarded one-hundred credits. According to this pay table, the odds of earning from thirty to thirty-four points are 1/908.95. Other points totals result in other awards as shown in the table of FIG. 19. The smallest award of one credit is given for earning from six to eleven points. In this example, the award is less than the wager (i.e., one credit awarded and two credits wagered). Including some awards that are less than the amount wagered allows for a higher win frequency.

An example of a pay table associated with a Keno game in which the player selects five spots for a wager of three credits is illustrated in FIG. 20. In this example, the maximum number of points the player can earn is fifty points. If the player earns from forty to fifty points, the player is awarded 750 credits. According to this pay table, the odds of earning from forty to fifty points are 1/14343.68. Other points totals result in other awards as shown in the table of FIG. 20. The smallest award of two credits is given for earning from nine to fourteen points. Again, the award is less than the wager (i.e., two credits awarded and three credits wagered).

An example of a pay table associated with a Keno game in which the player selects six spots for a wager of four credits is illustrated in FIG. 21. In this example, the maximum number of points the player can earn is sixty points. If the player earns from forty-five to sixty points, the player is awarded 1250 credits. Other points totals result in other awards as shown in the table of FIG. 21. The smallest award of two credits is given for earning from eleven to fifteen points. Again, the award is less than the wager (i.e., two credits awarded and four credits wagered).

An example of a pay table associated with a Keno game in which the player selects seven spots for a wager of five credits is illustrated in FIG. 22. In this example, the maximum number of points the player can earn is sixty-five points. If the player earns from forty-eight to sixty-five points, the player is awarded 1500 credits. Other points totals result in other awards as shown in the table of FIG. 22. The smallest award of two credits is given for earning from twelve to nineteen points. Again, the award is less than the wager (i.e., two credits awarded and five credits wagered).

An example of a pay table associated with a Keno game in which the player selects eight spots for a wager of six credits is illustrated in FIG. 23. In this example, the maximum number of points the player can earn is seventy points. If the player earns from fifty-one to seventy points, the player is awarded 2000 credits. Other points totals result in other awards as shown in the table of FIG. 23. The smallest award of three credits is given for earning from fourteen to nineteen points. Again, the award is less than the wager (i.e., three credits awarded and six credits wagered).

An example of a pay table associated with a Keno game in which the player selects nine spots for a wager of seven credits is illustrated in FIG. 24. In this example, the maximum number of points the player can earn is seventy-five points. If the player earns from fifty-seven to seventy-five points, the player is awarded 3200 credits. Other points totals result in other awards as shown in the table of FIG. 24. The smallest award of three credits is given for earning from sixteen to twenty-two points. Again, the award is less than the wager (i.e., three credits awarded and seven credits wagered).

An example of a pay table associated with a Keno game in which the player selects ten spots for a wager of eight credits is illustrated in FIG. 25. In this example, the maximum number of points the player can earn is eighty points. If the player earns from sixty to eighty points, the player is awarded 3200 credits. Other points totals result in other awards as shown in the table of FIG. 25. The smallest award of three credits is given for earning from eighteen to twenty-six points. Again, the award is less than the wager (i.e., three credits awarded and eight credits wagered).

An example of another pay table associated with a Keno game in which the player selects three spots for a wager of one credit is illustrated in FIG. 26. In this example, if the player matches on one spot, the player is awarded one credit. According to this pay table, the odds of matching on one spot are 1/2.3. In such an instance, the player would break even (i.e., one credit awarded and one credit wagered). Other numbers of matches result in other awards as shown in the table of FIG. 26.

An example of another pay table associated with a Keno game in which the player selects four spots for a wager of two credits is illustrated in FIG. 27. In this example, if the player matches on one spot, the player is not awarded any credits. If the player matches on two spots, the player is awarded four credits. If the player matches on three spots, the player is awarded seventeen credits. In such an instance, the player is awarded a noninteger multiple of the wager (i.e., seventeen credits awarded and two credits wagered). Other numbers of matches result in other awards as shown in the table of FIG. 27.

An example of another pay table associated with a Keno game in which the player selects five spots for a wager of three credits is illustrated in FIG. 28. In this example, if the player matches on one spot, the player is not awarded any credits. If the player matches on two spots, the player is awarded three credits (which is the break even point). If the player matches on three spots, the player is awarded eleven credits. Again, the player is awarded a noninteger multiple of the wager (i.e., eleven credits awarded and three credits wagered). Other numbers of matches result in other awards as shown in the table of FIG. 28.

An example of another pay table associated with a Keno game in which the player selects six spots for a wager of four credits is illustrated in FIG. 29. In this example, if the player matches on two spots, the player is awarded three credits. In other words, the player is given an award (e.g., three credits) that is less than the amount wagered (e.g., four credits). Other numbers of matches result in other awards as shown in the table of FIG. 29.

An example of another pay table associated with a Keno game in which the player selects seven spots for a wager of five credits is illustrated in FIG. 30. In this example, if the player matches on two spots, the player is awarded three credits. Again, the player is given an award (e.g., three credits) that is less than the amount wagered (e.g., five credits). Other numbers of matches result in other awards as shown in the table of FIG. 30.

An example of another pay table associated with a Keno game in which the player selects eight spots for a wager of six credits is illustrated in FIG. 31. In this example, if the player matches on two spots, no award is given. If the player matches on three spots, six credits are awarded (i.e., break even). If the player matches on four spots, twenty-one credits are awarded (i.e., a noninteger multiple of the wager). Other numbers of matches result in other awards as shown in the table of FIG. 31.

An example of another pay table associated with a Keno game in which the player selects nine spots for a wager of seven credits is illustrated in FIG. 32. In this example, if the player matches on two spots, no award is given. If the player matches on three spots, six credits are awarded (i.e., less then the amount wagered). If the player matches on four spots, fourteen credits are awarded (i.e., an integer multiple of the wager). If the player matches on five spots, fifty credits are awarded (i.e., a noninteger multiple of the wager). Other numbers of matches result in other awards as shown in the table of FIG. 32.

An example of another pay table associated with a Keno game in which the player selects ten spots for a wager of eight credits is illustrated in FIG. 33. In this example, if the player matches on two spots, no award is given. If the player matches on three spots, six credits are awarded (i.e., less then the amount wagered). If the player matches on four spots, twelve credits are awarded (i.e., a noninteger multiple of the wager). Other numbers of matches result in other awards as shown in the table of FIG. 33.

In summary, a number matching game which can be employed in both a gaming device and in live gaming at a casino has been provided. A player picks one or more number spots from a number pool. The gaming device or house draws randomly at least one number from the same pool. An award is provided to the player based on an amount of matches between the player selected number(s) (the spots) and the game drawn number(s). In one embodiment, the amount of the player's wager is a function of the number of spots the player selects. For example, an additional credit may be automatically wagered for each spot selected over a predefined threshold. In addition, the award provided to the player may be less than the amount wagered.

It should be understood that various changes and modifications to the presently preferred embodiments described herein will be apparent to those skilled in the art. Such changes and modifications can be made without departing from the spirit and scope of the present invention as claimed and without diminishing its intended advantages. It is therefore intended that such changes and modifications be covered by the appended claims.

The invention is claimed as follows:

1. A keno gaming device comprising:

at least one input device;

at least one display device;

at least one processor; and at least one memory device which stores a plurality of instructions, which when executed by the at least one processor, cause the at least one processor to operate with the at least one display device and the at least one input device, for each of a plurality of plays of a game, to:

display a plurality of selections;

enable a player to select a first set of the plurality of selections, the first set of the plurality of selections having a first set size based on a player-determined quantity of the selections selected by the player for the first set, said player-determined quantity of selections being any one of a plurality of different quantities of selections which are each greater than one and less than a predetermined quantity of the selections;

determine a variable wager amount based on said first set size of said first set of selections chosen by the player for said play of the game and independent of which selections are included in the first set of selections, the variable wager amount including at least a first portion based on a first wager amount per selection for a first subset of the first set of the plurality of selections and a second portion based on a different second wager amount per selection for a second subset of the first set of the plurality of selections, the first portion of the variable wager amount determined without regard for which selections are in the first subset, and the second portion of the variable wager amount determined without regard for which selections are in the second subset;

randomly determine a second set of the plurality of selections, said second set of the plurality of selections having a second set size; and cause an award to be provided to the player if a minimum number of matches occurs between the first set of the plurality of selections and the second set of the plurality of selections for said play of the game, said award being determined:

(a) based on a quantity of matches which occurs between the first set and the second set, (b) independent of which matches, if any, include any selections from the first subset of the plurality of selections, and (c) independent of which matches, if any, include any selections from the second subset of the plurality of selections.

2. The keno gaming device of claim 1, wherein the award provided to the player is one selected from a plurality of different awards and wherein at least one of the plurality of different awards is greater than zero and less than the variable wager amount.

3. The keno gaming device of claim 1, wherein the award provided to the player is a noninteger multiple of the variable wager amount.

4. The keno gaming device of claim 1, wherein the variable wager amount is equal in credits to the player-determined quantity of the selections selected by the player for the first set.

5. The keno gaming device of claim 1, wherein the variable wager amount is a multiple of the player-determined quantity of the selections selected by the player for the first set.

6. The keno gaming device of claim 1, wherein the variable wager amount is a sum of a first predetermined amount for the first subset of the first set of selections and a second different predetermined amount for the second subset of the first set of selections.

7. The keno gaming device of claim 6, wherein a sum of the quantity of selections of the first subset and the quantity of selections of the second subset is equal to the first set size.

8. The keno gaming device of claim 1, wherein:

if the player-determined quantity of the selections is at most three, the variable wager amount is equal to one credit;

if the player-determined quantity of the selections is equal to four, the variable wager amount is equal to two credits;

if the player-determined quantity of the selections is equal to five, the variable wager amount is equal to three credits; and wherein the award provided to the player is one of a plurality of awards, wherein at least one of the plurality of awards is greater than zero and less than the variable wager amount.

9. The keno gaming device of claim 1, wherein the player-determined quantity of the selections is restricted to a quantity from three selections to ten selections of the plurality of selections and the plurality of selections includes a quantity of selections associated with the numbers one to eighty.

10. The keno gaming device of claim 1, wherein the at least one processor is programmed to operate with the at least one display device to display one of: a match indication and a no-match indication indicating whether a first selection of the first set matches any of the selections of the second set after a first selection of the first set is selected by the player and before a second selection of the first set is selected by the player.

11. The keno gaming device of claim 1, wherein the game is based on at least one selected from the group consisting of a Keno game, a lottery game, and a Bingo game.

12. The keno gaming device of claim 1, wherein the at least one processor is programmed to randomly determine the second set of the plurality of selections.

13. The keno gaming device of claim 1, wherein the plurality of selections includes a plurality of numerical symbols.

14. A Keno gaming device comprising:

a cabinet;

a monitor supported by the cabinet;

at least one input device; and a processor programmed to operate with the monitor and the at least one input device to:

display a plurality of numbers, (ii) randomly determine a second set of the plurality of numbers, the second set having a second set size, the second set size being at least one and being less than the total quantity of the plurality of numbers, (iii) enable a player to sequentially select a first set of the plurality of numbers, the first set having a first set size based on a player-determined quantity of the numbers selected by the player for the first set, the player-determined quantity of the numbers being a quantity of the numbers which is any one of a plurality of different quantities and which is at least one, (iv) for each sequentially selected number of the first set of the plurality of numbers:

(a) increase the first set size, (b) determine whether the first set size exceeds a predetermined first subset size, (c) if the determination is that the first set size does not exceed the predetermined first subset size, update a variable wager amount based on a first wager amount per number regardless of which number is the selected number, (d) if the determination is that the first set size exceeds the predetermined first subset size, update the variable wager amount based on a different second wager amount per number regardless of which number is the selected number, and (e) display an indication of whether said selected number matches any of the numbers of the second set of the plurality of numbers, (v) determine an outcome for the player based on the variable wager amount and based on a quantity of matches which occurs between any number of the first set of the plurality of numbers and any number of the second set of the plurality of numbers, and (vi) cause the outcome to be provided to the player.

15. The Keno gaming device of claim 14, wherein the processor is programmed to determine said outcome by selecting an award from a plurality of awards based on the quantity of matches, wherein at least one of the plurality of awards is associated with a value which is greater than zero and less than the variable wager amount.

16. The Keno gaming device of claim 14, wherein the outcome is associated with a value which is a noninteger multiple of the variable wager amount.

17. The Keno gaming device of claim 14, wherein the variable wager amount is equal in credits to the player-determined quantity of the numbers selected by the player for the first set.

18. The Keno gaming device of claim 14, wherein the variable wager amount is a multiple of the player-determined quantity of the numbers selected by the player for the first set.

19. The Keno gaming device of claim 14, wherein the variable wager amount is a sum of a first predetermined amount for a first subset of the first set of the plurality of numbers and a second different predetermined amount for a second subset of the first set of the plurality of numbers.

20. The Keno gaming device of claim 19, wherein a sum of a quantity of the numbers of the first subset of the first set of the plurality of numbers and a quantity of the numbers of the second subset of the first set of the plurality of numbers is equal to the player-determined quantity of the numbers selected by the player for the first set.

21. The Keno gaming device of claim 14, wherein the processor is programmed to:

determine the variable wager amount to be three credits if the player-determined quantity of the numbers selected by the player for the first set is equal to one;

determine the variable wager amount to be three credits if the player-determined quantity of the numbers selected by the player for the first set is equal to two;

determine the variable wager amount to be three credits if the player-determined quantity of the numbers selected by the player for the first set is equal to three; and determine the variable wager amount to be four credits if the player-determined quantity of the numbers selected by the player for the first set is equal to four.

22. The Keno gaming device of claim 14, wherein the processor is programmed to restrict the player-determined quantity of the numbers selected by the player for the first set to a quantity between three numbers and ten numbers and wherein the plurality of numbers includes the numbers one to eighty.

23. The Keno gaming device of claim 14, wherein the processor is programmed to operate with the monitor to display one of: a match indication and a no-match indication after a first number of the first set of the plurality of numbers is selected by the player and before a second number of the first set of the plurality of numbers is selected by the player.

24. A method of operating a keno game, said method comprising:

causing a display device to display a plurality of selections;

enabling a player to cause a first set of the plurality of selections to be selected using an input device, the first set having a first set size based on a player-determined quantity of the selections selected by the player for the first set, the player-determined quantity of selections being any one of a plurality of different quantities of selections which are each at least one and less than a total quantity of the plurality of selections;

causing at least one processor to determine a variable wager amount based on the first set size and independent of which selections are included in the first set of the plurality of selections, the variable wager amount including at least a first portion based on a first wager amount per selection for a first subset of the first set of the plurality of selections and a second portion based on a different second wager amount per selection for a second subset of the first set of the plurality of selections, the first portion of the variable wager amount determined without regard for which selections are in the first subset, and the second portion of the variable wager amount determined without regard for which selections are in the second subset;

causing the display device to display the determined variable wager amount to the player;

randomly determining a second set of the plurality of selections, the second set including at least one selection and less than all of the plurality of selections; and causing an award to be provided to the player if a minimum number of matches occurs between the first set and the second set, the award being independent of which matches, if any include any selections from the first subset of the plurality of selections and being independent of which matches, if any, include any selections from the second subset of the plurality of selections.

25. The method of claim 24, wherein an amount associated with the award is based on a quantity of matches which occurs between the first set and the second set.

26. The method of claim 24, wherein an amount associated with the award is based on a number of points earned for a quantity of matches which occurs between the first set and the second set.

27. The method of claim 24, wherein an amount associated with the award is greater than zero and less than the variable wager amount.

28. The method of claim 24, wherein a total amount associated with the award provided to the player is a noninteger multiple of the variable wager amount.

29. The method of claim 24, wherein the variable wager amount is equal in credits to the player-determined quantity of the selections selected by the player for the first set.

30. The method of claim 24, wherein the variable wager amount is a multiple of the player-determined quantity of the selections selected by the player for the first set.

31. The method of claim 24, wherein the variable wager amount is a sum of a first predetermined amount for the first subset of the first set and a different second predetermined amount for the second subset of the first set.

32. The method of claim 31, wherein a sum of a quantity of the selections of the first subset and a quantity of the selections of the second subset is equal to the player-determined quantity of the selections selected by the player for the first set.

33. The method of claim 24, wherein displaying the plurality of selections includes displaying an electronic representation of a Keno card.

34. The method of claim 24, wherein displaying the plurality of selections includes providing a physical Keno card.

35. The method of claim 24, wherein randomly determining the second set of the plurality of selections includes generating at least one random number at a Keno gaming device.

36. The method of claim 24, wherein randomly determining the second set of the plurality of numbers includes generating a number at a central server, and which includes transmitting data indicative of the second set from the central server to a gaming device.

37. The method of claim 24, which includes displaying an indication of a match after a first member of the first set is selected by the player and before a second member of the first set is selected by the player.

38. The method of claim 24, wherein the plurality of selections includes a plurality of numbers.

39. The keno gaming device of claim 1, wherein the first wager amount per selection is lower than the second wager amount per selection.

40. The Keno gaming device of claim 14, wherein the first wager amount per number is lower than the second wager amount per number.

41. The method of claim 24, wherein the first wager amount per selection is lower than the second wager amount per selection.

* * * * *

UNITED STATES PATENT AND TRADEMARK OFFICE

CERTIFICATE OF CORRECTION

PATENT NO. : 7,837,547 B2
APPLICATION NO. : 11/011810
DATED : November 23, 2010
INVENTOR(S) : Lee E. Cannon It is certified that error appears in the above-identified patent and that said Letters Patent is hereby corrected as shown below:

In Claim 14, Column 17, Line 23, before "display" insert --(i)--.

Signed and Sealed this
First Day of February, 2011

David J. Kappos

David J. Kappos
*Director of the United States Patent and Trademark Office*